US007512351B2

(12) United States Patent
Itagaki et al.

(10) Patent No.: US 7,512,351 B2
(45) Date of Patent: Mar. 31, 2009

(54) IMAGE FORMING APPARATUS WHICH SUPPRESSES SELECTIVE DEVELOPMENT OF TONER

(75) Inventors: Seiko Itagaki, Hachioji (JP); Hiroshi Akita, Hachioji (JP); Isamu Miura, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 77 days.

(21) Appl. No.: 11/300,558

(22) Filed: Dec. 13, 2005

(65) Prior Publication Data

US 2006/0177234 A1 Aug. 10, 2006

(30) Foreign Application Priority Data

Feb. 10, 2005 (JP) ..... 2005-033968
Mar. 10, 2005 (JP) ..... 2005-066853

(51) Int. Cl.
*G03G 15/06* (2006.01)

(52) U.S. Cl. ..... 399/55; 399/270

(58) Field of Classification Search ..... 399/55, 399/270

See application file for complete search history.

(56) References Cited

U.S. PATENT DOCUMENTS 5,444,519 A * 8/1995 Motoyama et al. ..... 399/50
6,324,354 B1 * 11/2001 Tode et al. ..... 399/53

FOREIGN PATENT DOCUMENTS

| | | | |
|---|---|---|---|
| JP | 10-142908 | A | 5/1998 |
| JP | 2001-242688 | A | 9/2001 |
| JP | 2003-345136 | A | 12/2003 |
| JP | 2004-333709 | A | 11/2004 |

OTHER PUBLICATIONS

English abstract and drawings of JP 59211069 A.*

* cited by examiner

*Primary Examiner*—David M Gray
*Assistant Examiner*—Ruth N Labombard
(74) *Attorney, Agent, or Firm*—Frishauf, Holtz, Goodman & Chick, P.C.

(57) ABSTRACT

An image forming apparatus includes: an image carrying body; a latent image forming unit to form an electrostatic latent image on the image carrying body; a developing unit to develop the electrostatic latent image on the image carrying body to form a toner image, the developing unit including a developing agent carrying body to carry a developing agent in a development region, and a direct-current power supply and an alternating-current power supply, both applying a developing bias voltage to the developing agent carrying body, the developing bias voltage generated by superimposing a direct-current voltage to an alternating voltage; a printing rate detecting unit to detect a printing rate; and a control unit to control the alternating-current power supply, wherein the control unit controls an output of the alternating-current power supply based on a detection result of the printing rate detecting unit.

14 Claims, 14 Drawing Sheets

IMAGE FORMING APPARATUS WHICH SUPPRESSES SELECTIVE DEVELOPMENT OF TONER

BACKGROUND OF THE INVENTION

1. Field of the Invention

The present invention relates to an image forming apparatus of an electrophotographic system. In particular, the present invention relates to an image forming apparatus with an improved developing apparatus used in an image formation of an electrophotographic system.

2. Description of the Related Art

Development using a dry type toner is generally performed in a development process in an image forming process of the electrophotographic system. The toner is charged within a developing apparatus, and adheres to an image carrying body by electrostatic force to form a toner image.

The toner consists of an aggregate of fine particles having different particle diameters, but there are many cases where selective development by which toners of specific particle sizes are preferentially consumed, is performed in development. In particular, there are many cases where the selective development occurs in development processing of development is performed by applying alternating voltages.

In order to prevent the change of image quality caused by a change in particle size distribution of a developing agent due to the selective development, research have been made for measures regarding the selective development.

In Published Unexamined Japanese Patent Application No. 2001-242688 (hereinafter referred to as patent document 1), setting the frequency of an alternating bias voltage which forms an alternating electric field to a value at which the selective development does not occur is proposed.

In Published Unexamined Japanese Patent Application No. 2003-345136 (hereinafter referred to as patent document 2), selective development is prevented from occurring by devising the design of a magnet in a developing roller.

In Published Unexamined Japanese Patent Application No. 2004-333709 (hereinafter referred to as patent document 3), negative effect caused by the selective development is prevented by changing the direct-current voltage of a development bias when a developing apparatus is operated at non-image formation state, and by ejecting the toner, which has a reversed polarity from the developing apparatus to the image carrying body.

Moreover, in Published Unexamined Japanese Patent Application No. Hei 10-142908 (hereinafter referred to as patent document 4), preventing defective transfer from occurring by controlling the peak value of an AC component of a development bias voltage is proposed, though this prevention is not the prevention of selective development. That is, it is a developing apparatus which controls the peak value of an AC bias based on a history of a developing agent and prevents a defective transfer due to aged deterioration of the developing agent, therefore elongates usable period of the developing agent. The technique disclosed in patent document 4 cannot be used as a measure in a case where deterioration of a toner has progressed due to increase in the developing agent holding time when developing an image with a low printing rate.

In recent years, in a two-component developing system using a developing agent composed of a toner and a carrier, particle diameters of a toner which is easily used at time of development gets determined, and toner at the larger particle diameter side than the determined toner particle diameter or toner at the smaller particle diameter side than the determined toner particle diameter is used for development. Indefinitely, these toners stay in the developing apparatus. Consequently, problems concerning the progress of the deterioration of the toner, toner scattering, the deterioration of image quality, and the like are caused.

The phenomenon appears as a further remarkable phenomenon especially in the case where the printing rate is low. Moreover, when a developing agent stays in the developing apparatus and gets deteriorated, there is also a case in which the deterioration of the toner at the larger particle diameter side or at the smaller particle diameter side is large.

Accordingly, it became clear that the conventional techniques including the prior art mentioned above cannot prevent the selective development nor prevent the changes in image quality by the selective development sufficiently.

For example, by the technique disclosed in patent document 3, since the technique does not prevent any selective development while an image processing is conducted, image formation is performed by development accompanied with the selective development until ejection of toner is executed, and the deterioration of image quality cannot be fully prevented.

Moreover, the techniques disclosed in patent documents 1 and 2 adopt condition setting and apparatus configuration so as to prevent selective development. However, it is very difficult to adjust the setting or the apparatus configuration so as not to cause any selective development, and the changes in developing agents due to the selective development after a long period of operation and the changes of image quality is result are inevitable. Moreover, the deterioration of image quality due to the selective development does not only depend on the apparatus configuration and the particle size distribution of the toner used, but also depends on the characteristics of image to be formed and environment. Thus, the deterioration of the image quality due to the selective development cannot be fully prevented by an adjustment of the setting or the apparatus configuration.

SUMMARY OF THE INVENTION

According to the first aspect of the present invention, an image forming apparatus of the present invention comprises:

an image carrying body;

a latent image forming unit to form an electrostatic latent image on the image carrying body;

a developing unit to develop the electrostatic latent image on the image carrying body to form a toner image, the developing unit including a developing agent carrying body to carry a developing agent in a development region, and a direct-current power supply and an alternating-current power supply, both applying a developing bias voltage to the developing agent carrying body, the developing bias voltage generated by superimposing a direct-current voltage to an alternating voltage;

a printing rate detecting unit to detect a printing rate; and a control unit to control the alternating-current power supply, wherein the control unit controls an output of the alternating-current power supply based on a detection result of the printing rate detecting unit.

BRIEF DESCRIPTION OF THE DRAWINGS

The present invention will become more fully understood from the detailed description given hereinafter and the accompanying drawings which are given by way of illustration only, and thus are not intended as a definition of the limits of the scope of the invention, and wherein.

DETAILED DESCRIPTION OF THE PREFERRED EMBODIMENTS

An embodiment of the present invention is given hereafter with reference to figures, however, the present invention is not limited to the embodiment of the figures.

First Embodiment

First of all, with reference to FIGS. 1-4, selective development and the correction of the selective development in first embodiment of the present invention are described.

Figure 1:
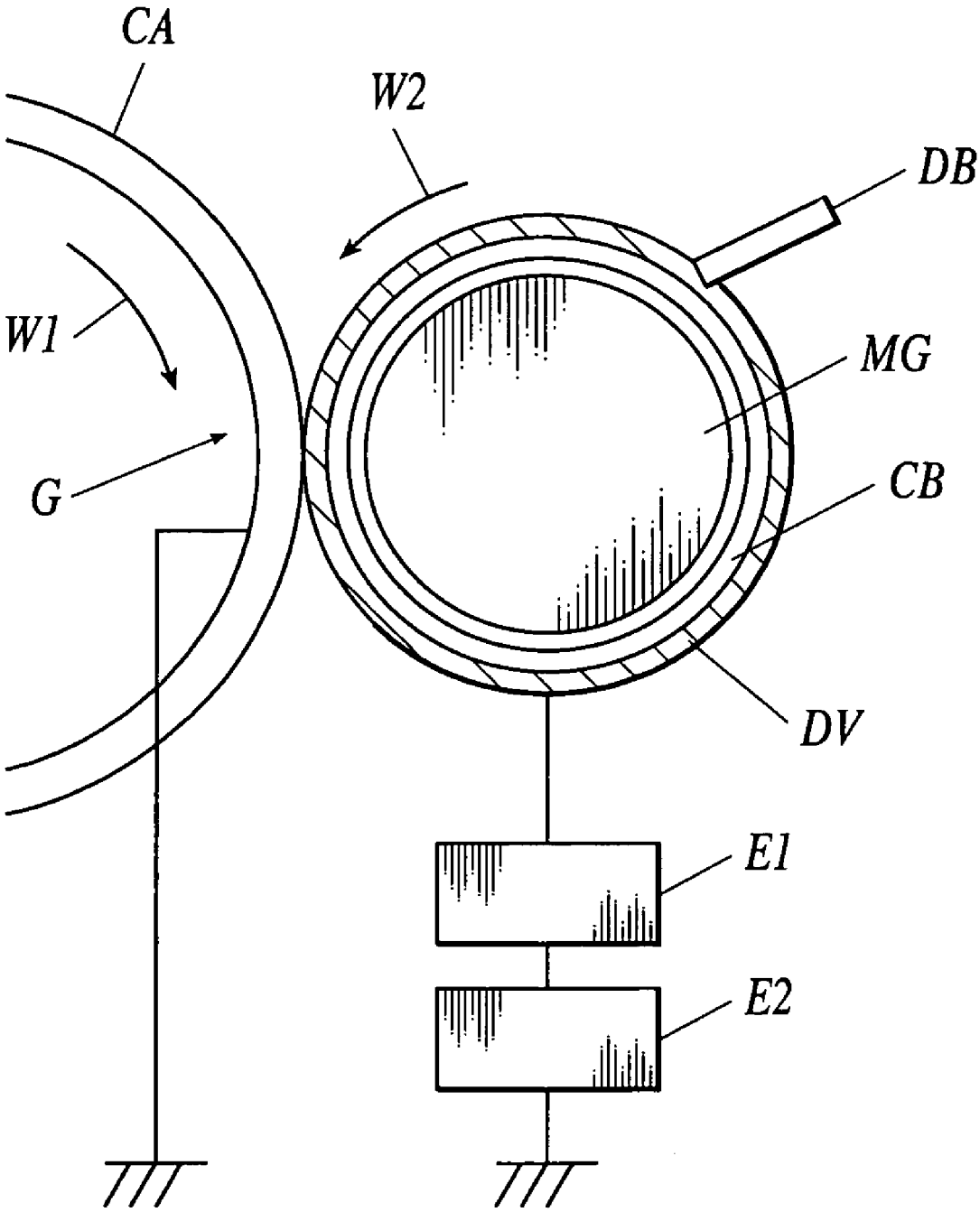
FIG. 1 is a view showing the principal part of a developing apparatus according to first embodiment of the present invention.

In FIG. 1, with regard to an image carrying body CA, which rotates clockwise as shown by an arrow W1, a developing agent carrying body CB, which is arranged to be opposed to the image carrying body CA rotates counterclockwise as shown by an arrow W2, and development is performed by a developing agent layer DV formed on the developing agent carrying body CB.

As the developing agent of the developing agent layer DV, a two-component developing agent including a toner and a magnetic carrier, and a one-component developing agent including a toner as the principal component thereof without including any carriers are used. For forming an image having high resolution and an excellent tone reproduction, a two-component developing agent using a small diameter toner is preferable, and, in the formation of a color image, the two-component developing agent is especially preferable.

A magnet roll MG is provided inside the developing agent carrying body CB. The magnet roll makes the developing agent adhere onto the developing agent carrying body CB, and forms a magnetic brush in a development region G.

In the development region G, the developing agent carrying body CB may be moved in the same direction, and rate of linear speed of the developing agent carrying body CB to the linear speed of the image carrying body CA may be made to be constant, or may be changeable so as to be controlled according to conditions. Here, the developing agent carrying body CB moves in the same direction as the image carrying body CA in the development region G in the shown example, however, the developing agent carrying body CB may be moved in the opposite direction.

Quantity of the developing agent on the developing agent carrying body CB is regulated by a regulating member DB.

A development bias voltage is applied to the developing agent carrying body CB by power supplies E1 and E2. The power supply E1 is a direct-current power supply, and the power supply E2 is an alternating-current power supply. Development can be performed by charged area development or reversal development. In the charged area development, the direct-current power supply E1 applies a development bias voltage having a polarity reverse to the polarity of a latent image. In the reversal development, the direct-current power supply E1 applies a development bias voltage having the same polarity as that of the latent image.

The alternating-current power supply E2 applies an alternating voltage having a voltage value (peak to peak) in the range of approximately 0.8 kV to approximately 1.8 kV and a frequency in the range of approximately 5 kHz to approximately 7 kHz. An alternating current having an arbitrary waveform such as a sine wave, a rectangular wave, and a triangular wave is used.

In the present specification, the alternating voltage Vac of the alternating current component of the development bias voltage is a peak to peak voltage.

Figure 2:
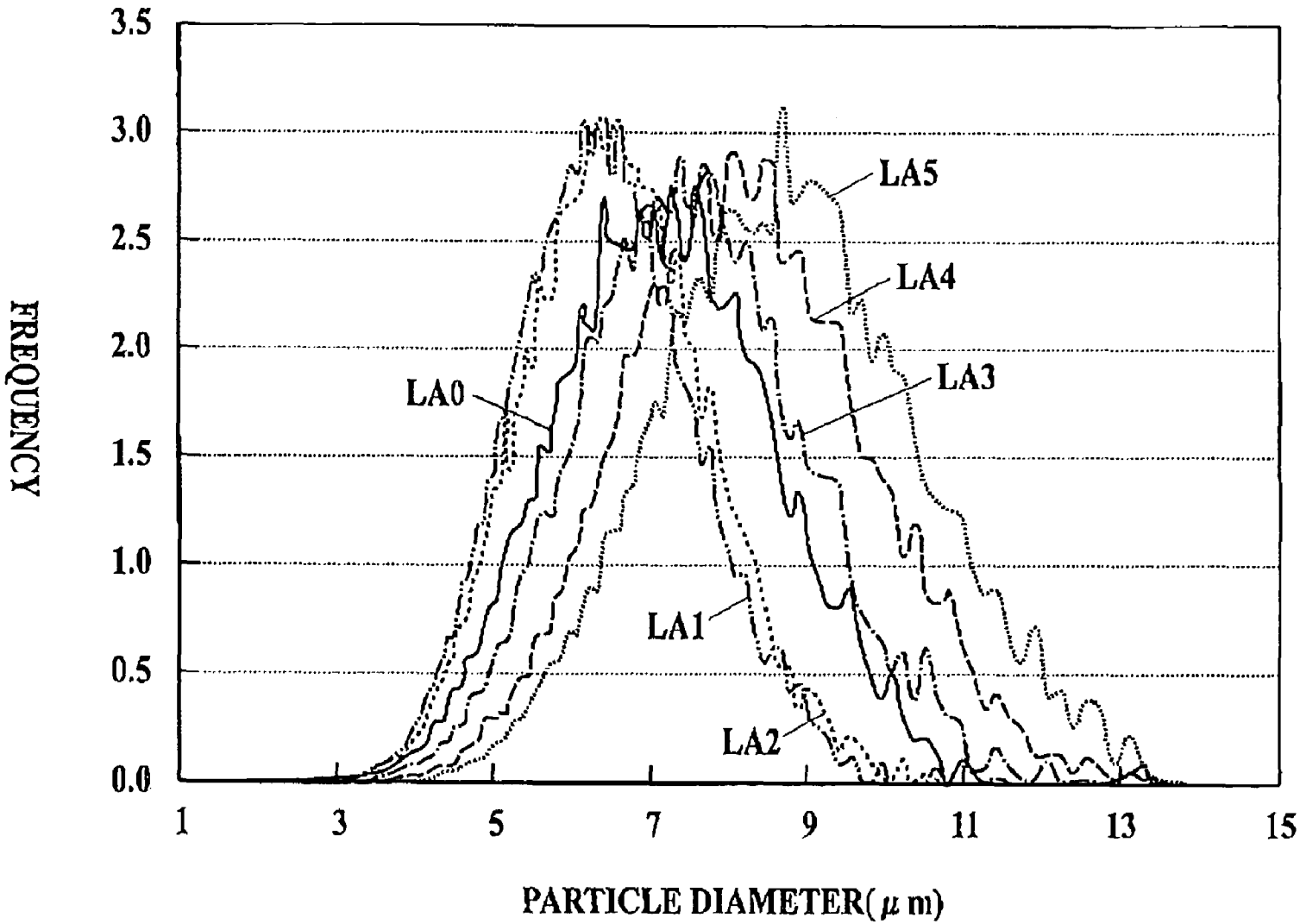
FIG. 2 is a graph showing particle size distributions of a toner within varying an alternating voltage Vac of a development bias voltage.

FIG. 2 shows the changes in the particle size distribution of a toner within varying the alternating voltage Vac of the development bias voltage.

A curve LA0 is a particle size distribution curve of the toner in the developing apparatus at time of starting, i.e. before the toner is consumed by development.

Curves LA1-LA5 are particle size distribution curves of the toner which forms toner images on the image carrying body CA, when development is performed by applying the alternating bias voltages as shown in Table 1.

The particle size distribution of Table 1 is a result when development was performed under the following conditions.

TABLE 1

| CURVE | AC VOLTAGE Vac |
|---|---|
| LA1 | 2.0 V |
| LA2 | 1.5 kv |
| LA3 | 1.0 kV |
| LA4 | 0.5 kv |
| LA5 | 0 V |

direct-current voltage Vdc: −500 V frequency f of alternating voltage: 5 kHz development interval: 0.3 mm (shortest distance between image carrying body CA and developing agent carrying body CB)

linear speed ratio Vs/Vp of developing agent carrying body CB to image carrying body CA: 2 (linear speed of image carrying body CA=Vp, linear speed of developing agent carrying body CB=Vs)

developing agent conveying quantity M conveyed by developing agent carrying body CB: 200-240 g/$m^2$ As apparent from FIG. 2, the higher the alternating voltage Vas is, the toner having smaller particle diameter is preferentially consumed. The lower the alternating voltage Vas is, the toner having larger particle diameter is preferentially consumed.

As apparent from the fact that the particle size distribution of a new toner and the particle size distribution of the toner used in the development are different from each other, the particle size distribution of the toner in the developing apparatus changes as the development proceeds when development is performed under an alternating electric field. That is, when developing is performed under a development bias having a high peak value, the toner having smaller particle diameters is preferentially consumed. As a result, the ratio of the toner having larger particle diameters becomes higher in the toner in the developing apparatus. When the development is performed under a development bias of a lower peak value, the toner having the larger particle diameters is preferentially consumed. As a result, the ratio of the toner having the smaller particle diameters becomes higher in the toner in the developing apparatus.

Theoretically, in the case where the peak value of the alternating voltage is set so that the particle size distribution of the toner consumed in development meets the particle size distribution of a new toner, the particle size distribution of the toner in the developing apparatus does not change even when the development is continuously proceeded. However, such setting is practically too difficult, and the changes in the particle size distribution of the toner in the developing apparatus are inevitable.

Figure 3:
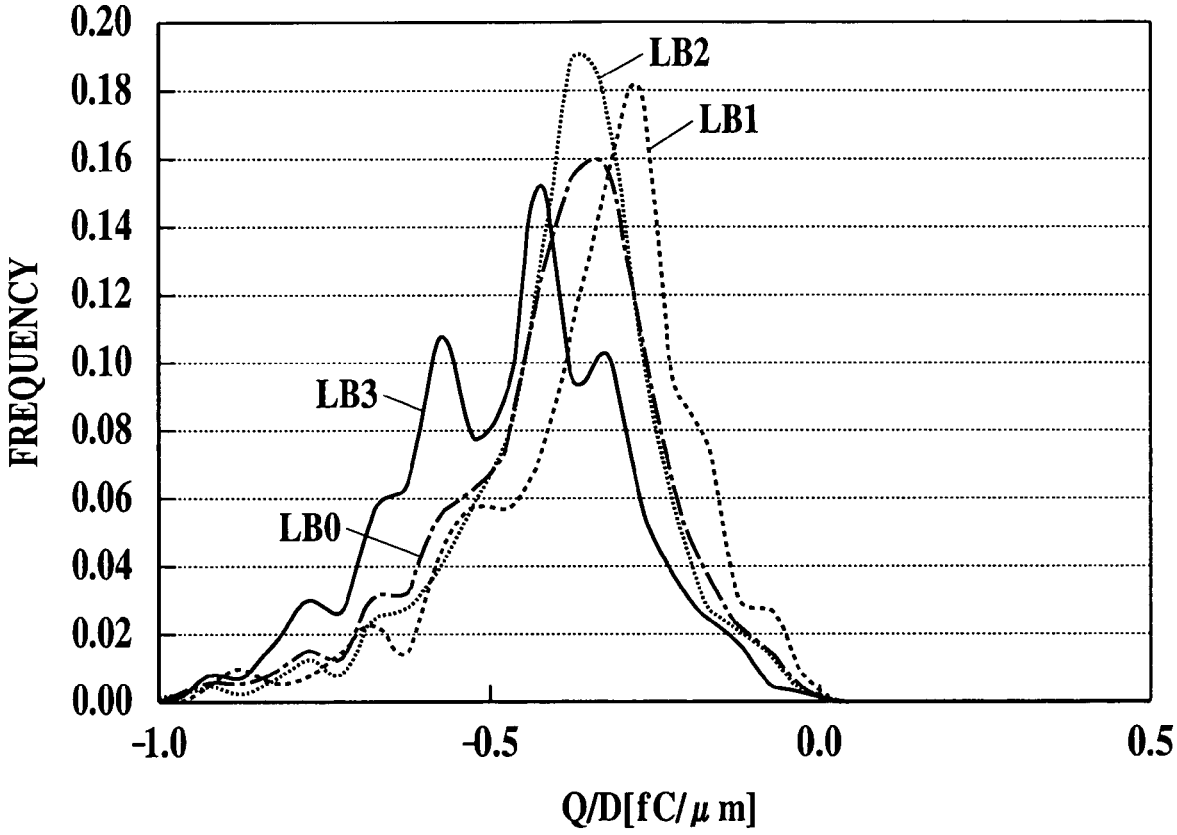
FIG. 3 is a graph showing charge quantities of the toner.

FIG. 3 shows the charge quantity distribution of a toner.

In FIG. 3, the charge quantity shows the charge quantity of each of the toner particles, and is expressed by charge quantity/particle diameter (Q/D). The unit is fC/μm.

Figure 4:
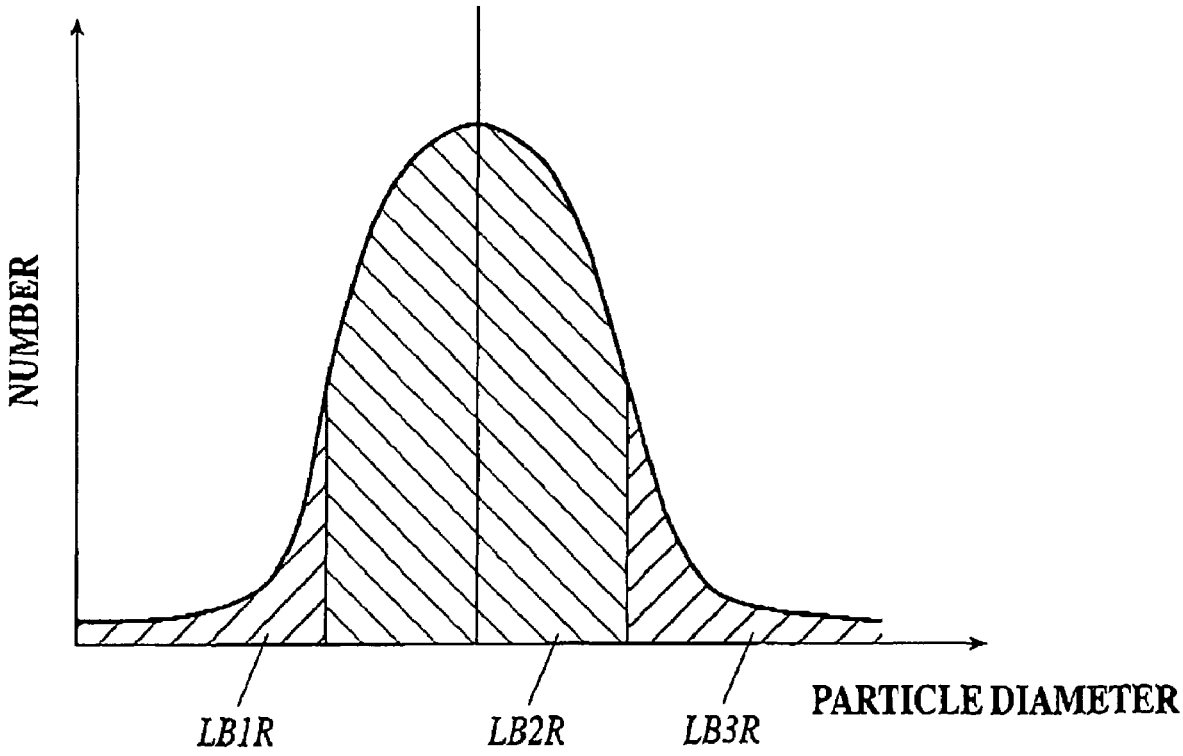
FIG. 4 is a graph showing sampling ranges of toner particles at the time of the measurement of a charge quantity distribution.

A curve LB0 indicates the charge quantity distribution of entire toner. A curve LB1 indicates the charge quantity distribution of the particles that compose smallest 20% within particle diameters. A curve LB2 indicates the charge quantity distribution of the particles that compose central 60% within particle diameters. A curve LB3 indicates the charge quantity distribution of the particles that compose largest 20% within particle diameters. That is, particles in the particle diameter ranges denoted by marks LB1R, LB2R and LB3R, which are shown in FIG. 4, have charge quantity distributions denoted by the curves LB1, LB2 and LB3 of FIG. 3, respectively.

The charge quantity Q/D of FIG. 3 is the result of measurement of the charge quantity when 5,000 sheets of images were formed by conducting development under the following conditions, using a negatively charged toner.

direct-current voltage Vdc: −500 V
alternating voltage Vac: 1 kV
alternating current frequency: 5 kHz
development interval Ds: 0.3 mm
speed ratio Vs/Vp: 2
developing agent conveying quantity M: 200-240 g/$m^2$
printing rate: 1%
(ratio of image area having density exceeding 0 to the entire image area)

As apparent from FIG. 3, the smaller the particle diameter of a toner is, the lower the charge quantity of the toner. It is well known that a development property changes by the difference in the charge quantity Q/D. When the charge quantity Q/D lowers, the generation of fogging or toner scattering can easily occur, and the roughening of a half-tone image becomes noticeable.

From the experiment results described above, it can be said that the particle size distribution of a toner changes as image formation is repeated, and due to this change, the charge quantity of the toner changes. Further, the change of the charge quantity can influence image quality to cause the deterioration of image quality.

Such a tendency becomes remarkable in the case of forming many images with a low printing rate. That is, when the images with low printing rate are formed in large quantity, image formation is continuously performed in a condition with small quantity of toner supply. As a result, deviation of the particle size distribution of the toner in the developing apparatus becomes large by selective development, resulting in deterioration of the image quality.

From the knowledge based on aforementioned experiment, in the present embodiment, the printing rate of the image to be formed is detected, and the alternating voltage Vac in a development bias is controlled based on detection result. Since a particle size distribution of the toner used for development changes according to the change in the alternating voltage Vac as shown in FIG. 1, the particle size distribution of the toner in the developing apparatus can be controlled by the control of the alternating voltage Vac, and the deviation of the particle size distribution of the toner in the developing apparatus due to forming low printing rate images can be prevented.

That is, the voltage Vac in the development bias is controlled based on the detection result. By the control, the changes in the particle size distribution of the toner in developing apparatus are suppressed, and undesirable phenomena such as fogging, half-tone roughening, toner scattering and the like are sufficiently suppressed.

Specifically, when the printing rate is detected and the printing rate is low, the control to change an alternating voltage Vac into a higher voltage is performed.

In a development mechanism of a development in which a development bias voltage is composed by superimposing an alternating voltage on the direct-current voltage, a part of the alternating voltage which contributes to the development is a wave of one polarity, and the development property is controlled by the control of the peak value, namely the half of the alternating voltage Vac. Therefore, theoretically, the selective development can be prevented by controlling the peak value, the half of the alternating voltage Vac and the deterioration of the image quality can be prevented. However, the image quality control within prevention of the selective development is actually performed by controlling the alternating voltage Vac.

Here, the printing rate is a ratio of $\int Gd$, a cumulative value of the image data Gd, whose density of the image is not zero, to $\int Gs$, a cumulative value of image area Gs, and is expressed by $\int Gs/\int Gd \times 100\%$. The printing rate is calculated for every image formation of predetermined number of sheets.

The predetermined number of sheets is the number of sheets previously determined to a certain number such as 100 sheets, or the number of sheets formed by one image formation job set by an operation unit or externally, and these numbers can be combined to form the predetermined number.

Figure 5:
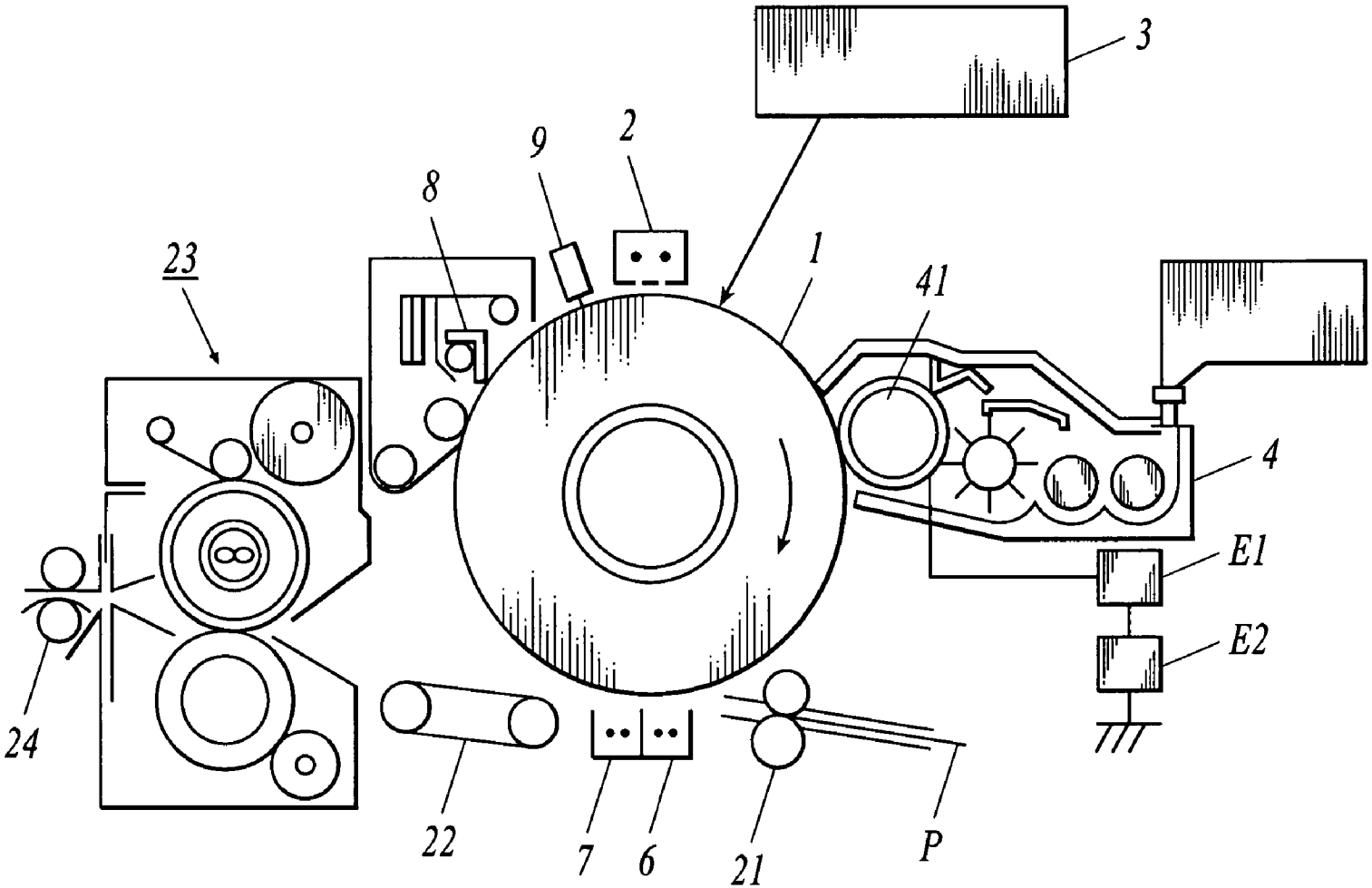
FIG. 5 is a view showing an outline of an image forming apparatus according to the first embodiment of the present invention.
Figure 6:
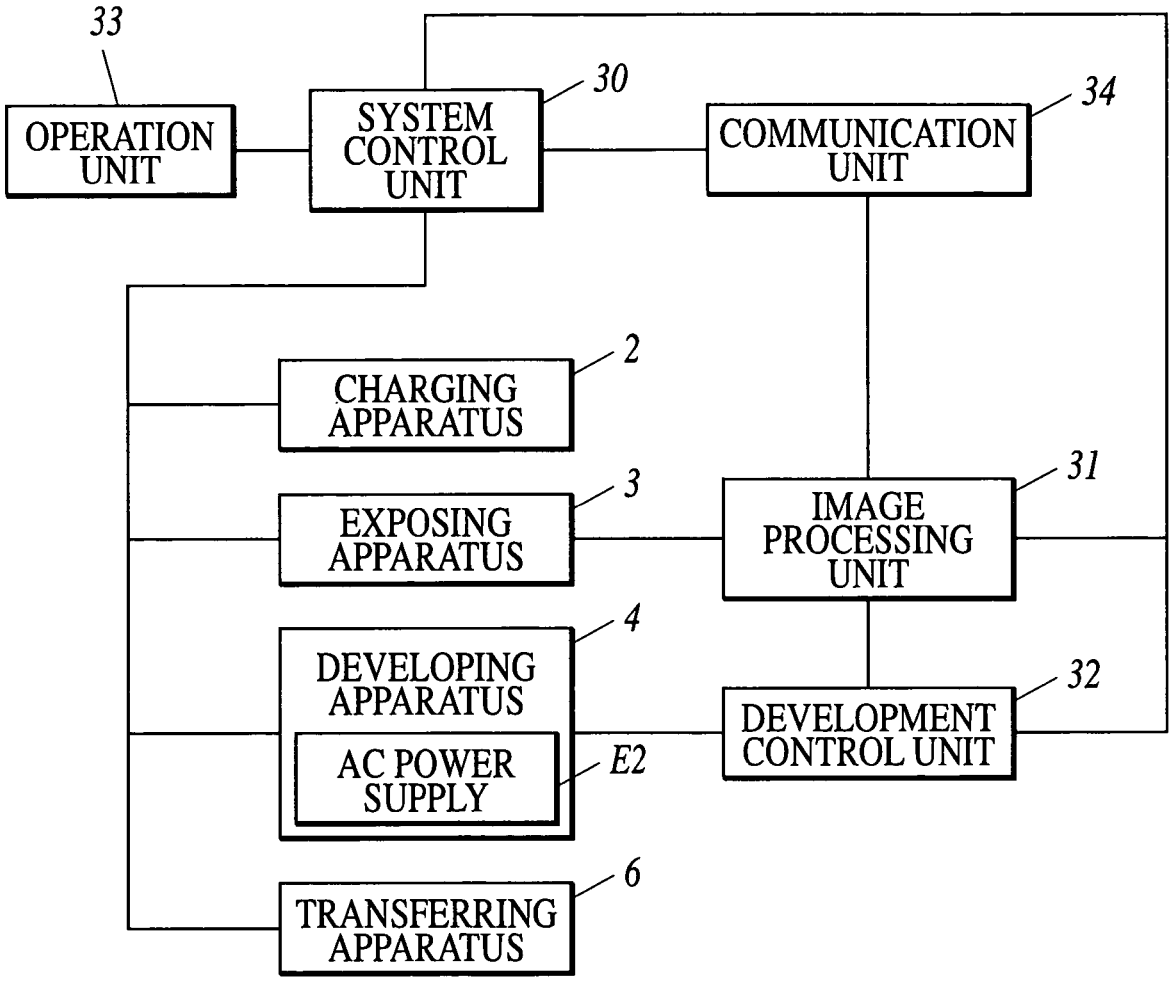
FIG. 6 is a block diagram of a control system of the first embodiment of the present invention.

FIG. 5 is a view showing an outline of an image forming apparatus A1 according to first embodiment, and FIG. 6 is a block diagram of a control system of the image forming apparatus A1 according to the first embodiment.

Photosensitive body 1 is a drum-shaped photosensitive body as an image carrying body. The photosensitive body is formed as a photosensitive body layer including a charge transport layer, obtained by applying a phthalocyanine pigment dispersed in polycarbonate, as an organic semiconductor layer of minus charge, onto a cylinder-shaped grounded substrate made of a metal. The photosensitive body is driven to rotate in an arrow direction.

Charging appratus 2 is a charging apparatus structured with scorotron charging, which performs charge processing of the rotating photosensitive body 1 to a predetermined polarity and a predetermined potential. The charging apparatus 2 charges the surface of the photosensitive body 1 uniformly.

An exposing apparatus 3 is an exposing apparatus of a laser scanning system, and uses a semiconductor laser (LD) as the light emitting element. The image exposing apparatus 3 exits a laser beam to perform a scanning exposure of the surface of the photosensitive drum 1 which is uniformly charged, and forms an electrostatic latent image. The charging apparatus 2 and the exposing apparatus 3 structure a latent image forming unit.

Developing apparatus 4 as developing unit forms a toner image by developing the electrostatic latent image on the photosensitive drum 1 with a developing agent on a developing sleeve 41 as a developing agent carrying body, which rotates opposingly to the photosensitive drum 1. Either contact or non-contact development is performed by a development using a two-component developing agent within a combination of image exposure and reversal development. The developing sleeve 41 is configured by covering the circumference of a magnet roll with a sleeve made of aluminum, which has been applied stainless spraying surface treatment. In the developing sleeve 41, development is performed with a development bias voltage generated by superimposing a direct-current component of the power supply E1 on an alternating current component of the power supply E2. The reversal development, in which the power supply E1 applies a voltage having the same charging polarity as that of the photoconductive body 1, is preferrable.

Development is performed using a two-component developing agent containing a toner and a magnetic carrier. As the toner, a polymerized toner having a number median diameter within a range of 3 μm to 8 μm is preferable, and particularly a polymerized toner having a number median diameter within a range of 5 μm to 7 μm is preferable. By using the polymerized toners, it becomes possible to realize an image forming apparatus having high resolution, a stable density and significantly less occurrence of fogging.

As the carrier, a carrier with a ferrite core composed of magnetic particles having a number median diameter within a range of 30 μm to 65 μm is preferable.

Transferring apparatus 6 is a corotron, i.e. a transferring apparatus composed of a corona charger composed of a wire and a back plate. The corotron 6 transfers a toner image on the photosensitive drum 1 onto transfer paper by a transfer current within constant current control.

Separating apparatus 7 is a separating apparatus composed of a corotron charger. The separating apparatus 7 promotes separation of transfer paper from the photosensitive drum 1 by a separating current of an AC component and a DC component.

A recording material P fed from a paper feeding unit is fed in synchronization with a toner image formed on the photosensitive drum 1 by resist rollers 21, and receives transfer of the toner image by the transferring apparatus 6 at a transfer nip unit. The recording material P which passed the transfer nip unit is separated from the surface of the photosensitive drum 1 by the separating apparatus 7, and is conveyed to a fixing apparatus 23 by a conveying belt 22.

The recording material P carrying the toner image is processed to be fixed by the fixing apparatus 23, and is ejected onto a catch tray, which is located outside of the machine and is not shown, by paper ejecting rollers 24.

On the other hand, the surface of the photosensitive drum 1 after the transfer of the toner image to the recording material P is cleaned by a cleaning apparatus 8 to remove residual toner. In the present embodiment, a blade made of urethane rubber is used as a cleaning unit provided to the cleaning apparatus 8, and the cleaning blade performs the cleaning by slidably contacting with the circumferential surface of the photosensitive drum 1 in a counter type fashion. The circumferential surface of the photosensitive drum 1, which passed the cleaning apparatus 8, and its surface cleaned, is irradiated by pre-charge exposure (PCL) unit 9, and moves on to the next image forming cycle in a condition with lowered residual potential.

FIG. 6 is a block diagram showing a control system of the image forming apparatus A1 according to the first embodiment.

System control unit 30 controls the image forming apparatus entirely, and image processing unit 31 generates image data for to drive the exposing apparatus 3 based on the image data obtained by reading a manuscript or the image data received from external equipment. Development control unit 32 is a development control unit as a control unit and a printing rate detecting unit that performs the image quality control described before, operation unit 33 is a unit to operate various kinds of operations, and communication unit 34 is a communication unit to communicate with external equipment such as a personal computer and a facsimile.

Alternating-current power supply E2 is an alternating-current power supply which applies a development bias voltage to the developing sleeve 41, as shown in FIG. 5.

In an image forming step to form an image on a record material, the system control unit 30 starts and/or stops the charging apparatus 2, the exposing apparatus 3, the developing apparatus 4 and the transferring apparatus 6 at predetermined timing to form an image on the record material.

In the image quality control step in a copied image forming step, in order to control the alternating-current power supply E2 based on a printing rate and control the alternating voltage Vac, the development control unit 32 calculates the entire image area based on the size information and the sheet number information which have been set by an operator from the operation unit 33. The development control unit 32 also inputs image data from the image processing unit 31, and calculates an image data quantity. When the image is a binary format image, the image data quantity is the integrated value of the dot number of black pixels. When the image is a multilevel image, the image data quantity is an integrated quantity of pixels.

The development control unit 32 calculates the percentage of the image data quantity to the entire image area, $\int Gd/\int Gs\times 100$ for every image formation of a predetermined number of sheets. The development control unit 32 controls the alternating-current power supply E2 based on calculation result, and thus controls the alternating voltage Vac.

Here, in the calculation of the printing rate, the printing rate can be also calculated by an approximate calculation, such as calculation based on the supposition that the widths of images are constant independent of sizes and the value obtained by integrating lengths of images (the length of the recording material P in the conveying direction in FIG. 5) is taken as the entire image area $\int Gs$.

Moreover, regarding that deviation of the particle size distribution of a toner due to selective development occurs when a toner consumption rate is low, the printing rate can be obtained by performing an approximation calculation which takes the toner consumption, the percentage of the image data quantity to the rotation quantity of the developing sleeve 41 in FIG. 5, as the printing rate.

In the print image forming step to perform image formation based on the image data received externally, the development control unit 32 calculates the entire image area based on the size information and the sheet number information of the recording image, obtained from the communication unit 34, and calculates the image data quantity based on the image data included in one job. Then, the development control unit 32 calculates the printing rate from these calculation results.

The development control unit 32 controls the alternating-current power supply E2 based on the calculated printing rate to control the alternating voltage Vac.

As described above, the control of the alternating voltage Vac is the control which makes the alternating voltage Vac high when the printing rate is low. As an aspect of the control of the alternating voltage Vac, the alternating voltage Vac may be continuously changed according to the printing rate, or the alternating voltage Vac may be related to the printing rate stepwise. As a typical aspect of the control, there is a way that sets a threshold value of the printing rate. When the printing rate is equal to or more than the threshold value, the standard alternating voltage Vac is applied. When the printing rate is below the threshold value, the alternating voltage Vac higher than the threshold value is applied.

By such control of the alternating bias voltage, selective development is suppressed, and high image quality is always maintained.

For preventing the deterioration of the image quality which occurs when the images having low printing rates are formed, in addition to the above-mentioned control of changing the alternating voltage Vac, it is preferable to control the ratio Vs/Vp, a ratio of linear speed Vs of the developing sleeve 41 to the linear speed Vp of the photosensitive body, according to the printing rate.

That is, in the case where the printing rate is low, the deterioration of toner is prevented by the control of making the ratio Vs/Vp low, and fogging, half-tone roughening, toner scattering and the like can be prevented.

As aforementioned, in the first embodiment, the changes of the particle size distribution of the toner in developing means, due to execution of selective development, resulting deterioration of image quality such as fogging and half-tone roughening, and the scattering of toner can be prevented, and an image forming apparatus which stably forms an image having high image quality can be realized.

The particle size distribution of the toner in the developing unit shifts to a small particle diameter side due to the selective development, and deterioration of image quality and the scattering of the toner occurs easily. However, these undesirable phenomena are fully prevented, and the image forming apparatus which stably forms an image having high image quality is realized by the first embodiment.

The undesirable phenomena that are produced by selective development are prevented significantly by the first embodiment.

A printing rate can be detected without adding any special equipment for detecting the printing rate by the first embodiment.

Second Embodiment

Hereinafter, a second embodiment of the present invention is described. However, these descriptions do not limit the technical ranges of claims and the meanings of terms.

[Image Forming Apparatus]

Figure 7:
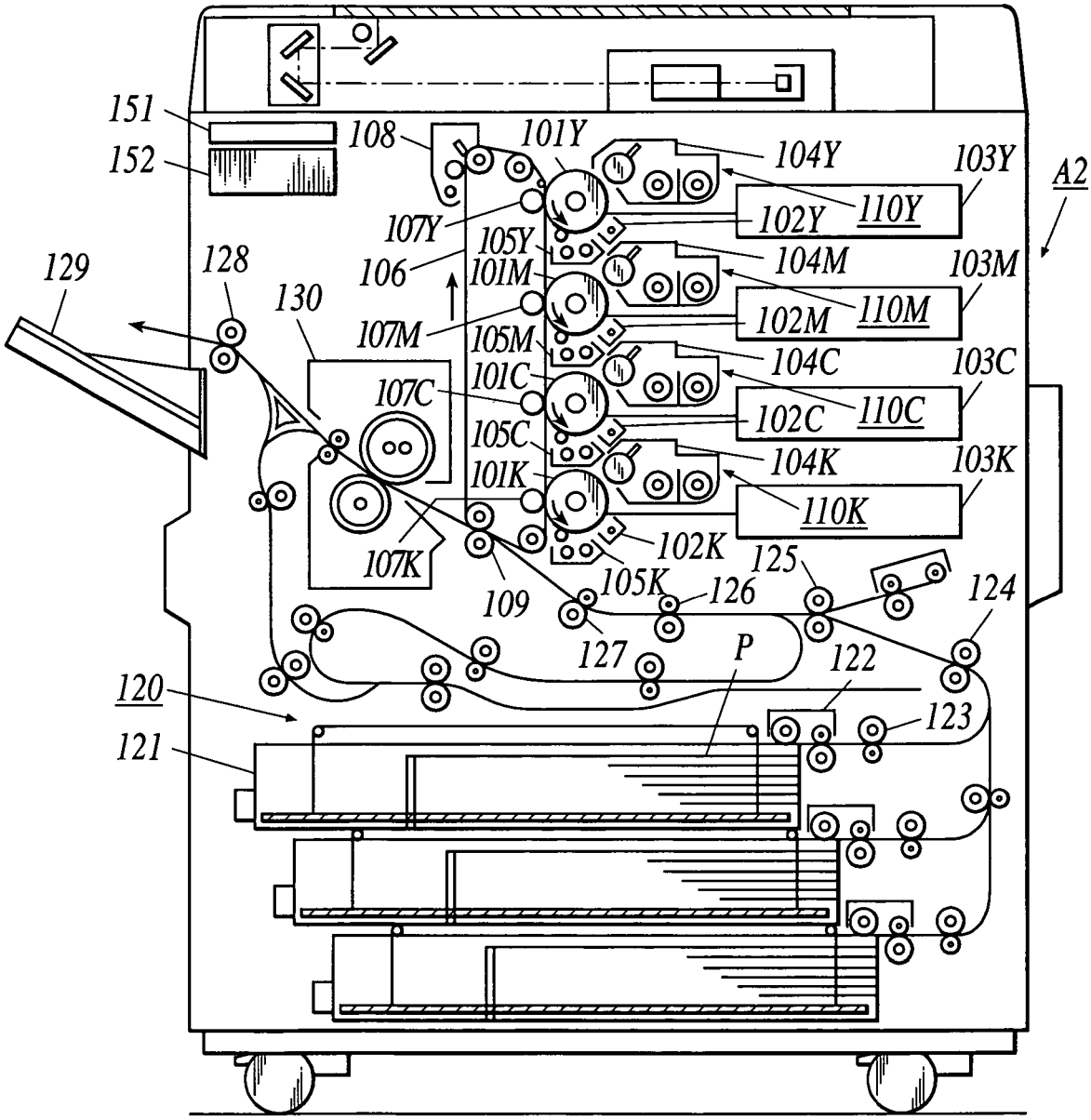
FIG. 7 is a configuration diagram of an image forming apparatus according to second embodiment of the present invention.

FIG. 7 is a configuration diagram of an image forming apparatus according to second embodiment.

The image forming apparatus 2A is called as a tandem type color image forming apparatus, and composed of a plurality of sets of image forming unit 110Y, 110M, 110C, 110K, a belt-like intermediate transfer body 106, a paper feeding-apparatus 120, and a fixing apparatus 130.

The image forming unit 110Y which forms an image of a yellow (Y) color includes charging apparatus 102Y arranged around a photosensitive drum 101Y as an image carrying body, exposing apparatus 103Y, a developing apparatus 104Y as a developing unit, and cleaning unit 105Y. The image forming unit 110M which forms an image of a magenta (M) color includes a photosensitive drum 101M as an image carrying body, charging apparatus 102M, exposing apparatus 103M, a developing apparatus 104M as a developing unit, and cleaning unit 105M. The image forming unit 110C which forms an image of a cyan (C) color includes a photosensitive drum 101C as an image carrying body, charging apparatus 102C, exposing apparatus 103C, a developing apparatus 104C as a developing unit, and cleaning unit 105C. The image forming unit 110K which forms an image of a black (K) color includes a photosensitive drum 101K as an image carrying body, charging apparatus 102K, exposing apparatus 103K, a developing apparatus 104K as a developing unit, and cleaning unit 105K.

The charging apparatus 102Y and the exposing apparatus 103Y, the charging apparatus 102M and the exposing apparatus 103M, the charging apparatus 102C and the exposing apparatus 103C, the charging apparatus 102K and the exposing apparatus 103K constitute latent image forming unit.

The developing apparatuses 104Y, 104M, 104C and 104K are developing apparatuses which contains two-component developing agents each composing of toners of yellow (Y), magenta (M), cyan (C) and black (K), which has a small particle diameter, and a carrier, respectively.

The intermediate transfer body 106 is winded by a plurality of rollers, and is supported to be revolvable.

The image of each color formed by the image forming unit 110Y, 110M, 110C and 110K is transferred onto the revolving intermediate transfer body 106 by primary transfer unit 107Y, 107M, 107C and 107K, one by one respectively, and a synthesized color image is formed.

Recording paper P contained in a paper feeding cassette 121 of the paper feeding apparatus 120 is fed by paper feeding unit (a first paper feeding unit) 122, and the recording paper P is conveyed to secondary transfer unit 109 through paper feeding rollers 123, 124, 125, 126, resist rollers (a second paper feeding unit) 127, and the like. Then, a color image is transferred on the recording paper P.

After the color toner image (or a toner image) on the recording paper P, on which the color image is transferred, is fixed by the fixing apparatus 130, the recording paper P is nipped by paper ejecting rollers 128, and is laid on a paper ejecting tray 129 outside the machine.

On the other hand, the residual toner on the intermediate transfer body 106, which has separated the recording paper P after transferring the color image onto the recording paper P by the secondary transfer unit 109, is removed by intermediate transfer body cleaning unit 108.

Here, color-image formation is described by description of the image forming apparatus A2, however, the case of forming a monochrome image is also included in the present invention.

[Configuration of Developing Apparatus]

Figure 8:
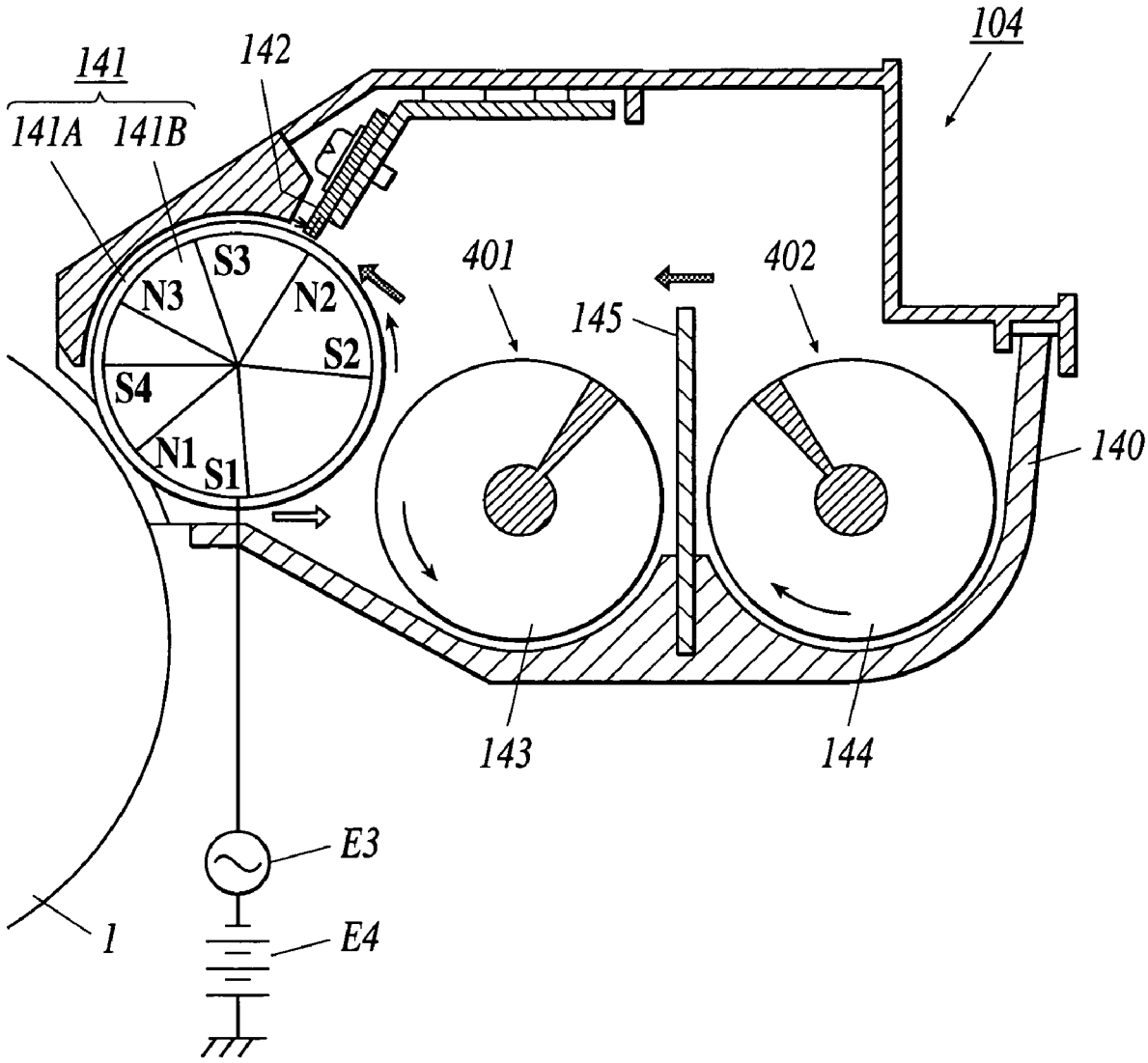
FIG. 8 is a sectional view of a developing apparatus according to the second embodiment of the present invention.
Figure 9:
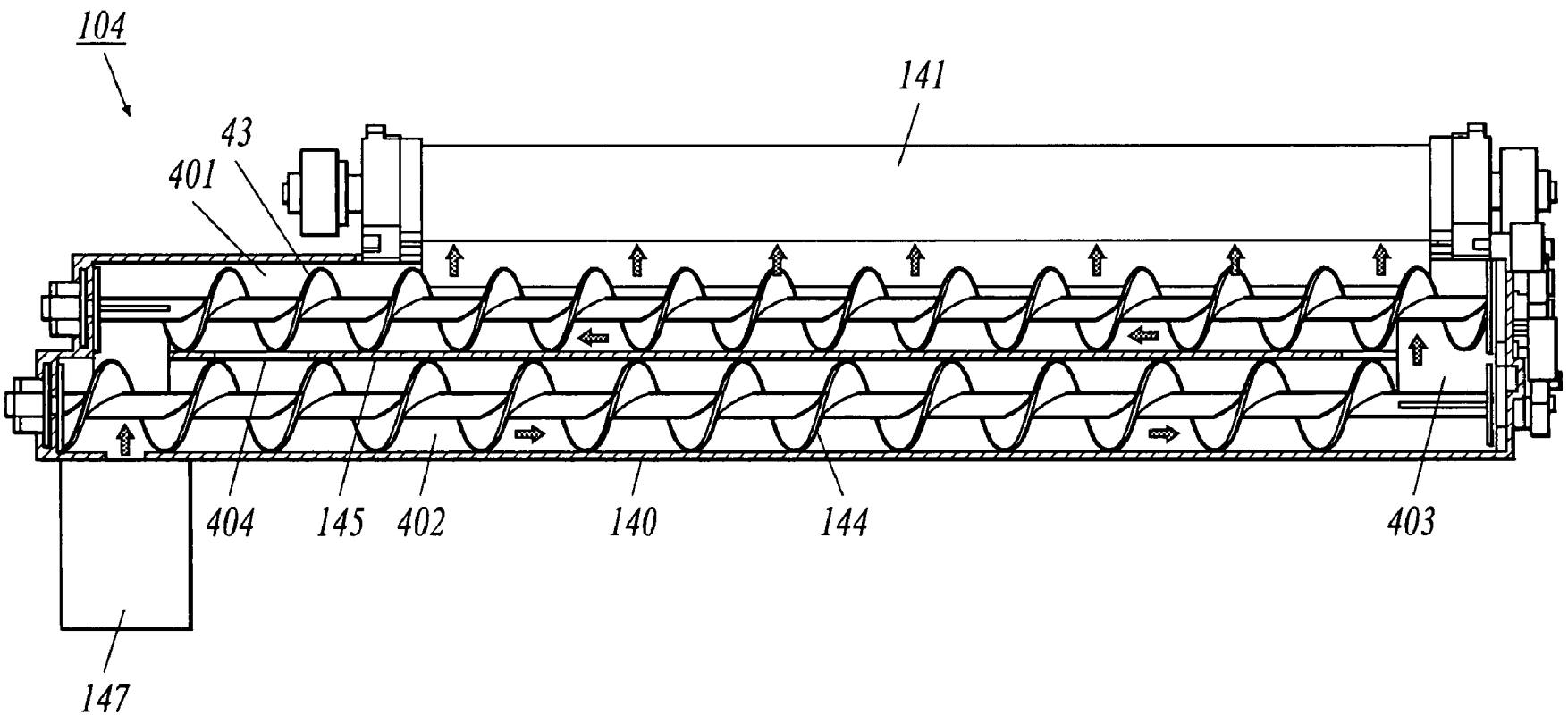
FIG. 9 is a plane view of a lower mechanism of the developing apparatus according to the second embodiment of the present invention.

FIG. 8 is a sectional view of a developing apparatus 104 according to the second embodiment. FIG. 9 is a plane view of the lower mechanism of the developing apparatus 104. Hereinafter, image carrying bodies 101Y, 101M, 101C and 101K are called as a photosensitive drum 101; the charging apparatuses 102Y, 102M, 102C and 102K are called as charging apparatus 102; the exposing apparatuses 103Y, 103M, 103C and 103K are called as exposing apparatus 103, and the developing apparatuses 104Y, 104M, 104C and 104K are called as a developing apparatus 104.

The developing apparatus 104 is composed of a developing apparatus main body 140, a developing roller 141, a developing agent quantity regulating member 142, a developing agent supplying member (hereinafter referred to as a supplying screw) 143, a developing agent agitating member (hereinafter referred to as an agitating screw) 144, and the like. The developing roller 141 is composed of a developing agent carrying body 141A and magnetic field generating unit 141B.

At a point where the developing agent carrying body 141A and the supplying screw 143 come close to face each other, the developing agent carrying body 141A rotates from a lower part to an upper part, and the supplying screw 143 rotates from the upper part to the lower part. The developing agent quantity regulating member 142 is arranged near to a scooping magnetic pole S2 of the magnetic field generating unit 141B.

The developing apparatus main body 140 is composed of a developing agent supplying chamber 401 in which the supplying screw 143 is contained, and a developing agent agitating chamber 402 in which the agitating screw 144 is contained. The developing agent supplying chamber 401 and the developing agent agitating chamber 402 are formed on both sides with a partition member 145 which stands straight from the bottom of the developing apparatus main body 140.

The developing roller 141, which is composed of the developing agent carrying body 141A and the magnetic field generating unit 141B, is arranged to face the photosensitive drum 101, which carries an electrostatic latent image, and is rotatably supported. An alternating voltage from an alternating-current power supply E3 and a direct-current voltage from a direct-current power supply E4 are superimposed as a developing bias to the developing agent carrying body 141A.

The alternating-current power supply E3 applies an alternating voltage having a voltage value (peak to peak) in the range of approximately 0.8 kV to approximately 1.8 kV and a frequency in the range of approximately 5 kHz to approximately 7 kHz. An alternating current having an arbitrary waveform such as a sine wave, a rectangular wave and a triangular wave is used.

In the present specification, the alternating voltage Vac of the alternating current component of the development bias voltage is a peak to peak voltage.

As shown in FIG. 8, at the point where the developing agent carrying body 141A and the supplying screw 143 come close to face each other, the developing agent carrying body 141A rotates from the lower part to the upper part, and the supplying screw 143 rotates from the upper part to the lower part.

The magnetic field generating unit 141B is arranged inside the developing agent carrying body 141A, and has seven magnetic poles N1, N2, N3, S1, S2, S3 and S4. The magnetic pole N1 is the main magnetic pole; the magnetic pole S1 is a stripping magnetic pole; and the magnetic pole S2 is a scooping magnetic pole.

Among the plurality of magnetic poles of the magnetic field generating unit 141B, the two magnetic poles S1 and S2, which adjoin mutually, are arranged to take the same polarity, and form a repulsive magnetic field. The stripping magnetic pole S1 to strip the developing agent strips the developing agent on the developing agent carrying body 141A. The scooping magnetic pole S2 to receive the developing agent pumps the developing agent supplied from the supplying screw 143, and adheres the pumped developing agent onto the developing agent carrying body 141A.

[Circulation Conveyance of Developing Agent]

(1) On the upper stream side of the developing agent agitating chamber 402, the developing agent which flows back from the developing agent supplying chamber 401 and a new toner replenished from toner replenishing unit 147 are carried in, and are agitated to be mixed by the agitating screw 144.

(2) The mixed developing agent passes a first aperture portion 403 located on the downstream side of the developing agent agitating chamber 402, and is conveyed to be introduced into the upstream side of the developing agent supplying chamber 401. In the developing agent supplying chamber 401, the developing agent is conveyed in a developing agent moving direction by the supplying screw 143.

(3) The supplying screw 143 releases the developing agent to the developing roller 141, as well as conveys the developing agent in the direction of the rotation axis thereof.

(4) The developing agent on the developing roller 141 is processed to be developed in a developing agent region which faces the photosensitive drum 101. The developing agent with a lowered toner density after developing is processed, is stripped from the developing roller 141 by the stripping magnetic pole S1.

(5) The stripped developing agent is carried into the developing agent supplying chamber 401.

(6) The developing agent conveyed into the developing agent supplying chamber 401 is further conveyed by the supplying screw 143, and passes a second aperture portion 404 to be introduced into the developing agent agitating chamber 402 on the upstream side.

(7) In the developing agent agitating chamber 402, replenishment of toner is performed by toner replenishing means 147 based on a toner density detection signal from a toner density sensor not shown.

[Developing Agent]

The developing agent is a two-component developing agent which is composed of a magnetic carrier and a nonmagnetic polymerized toner. The magnetization quantity of the magnetic carrier for 1 kilo-oersted is within a range of 20 emu/g to 70 emu/g, and the particle diameters of the magnetic carrier are 50 μm or less. The particle diameters of the nonmagnetic polymerized toner are 7.5 μm or less.

[Frequency Control for Alternating-Current Power Supply of Developing Agent Carrying Body]

Figure 10:
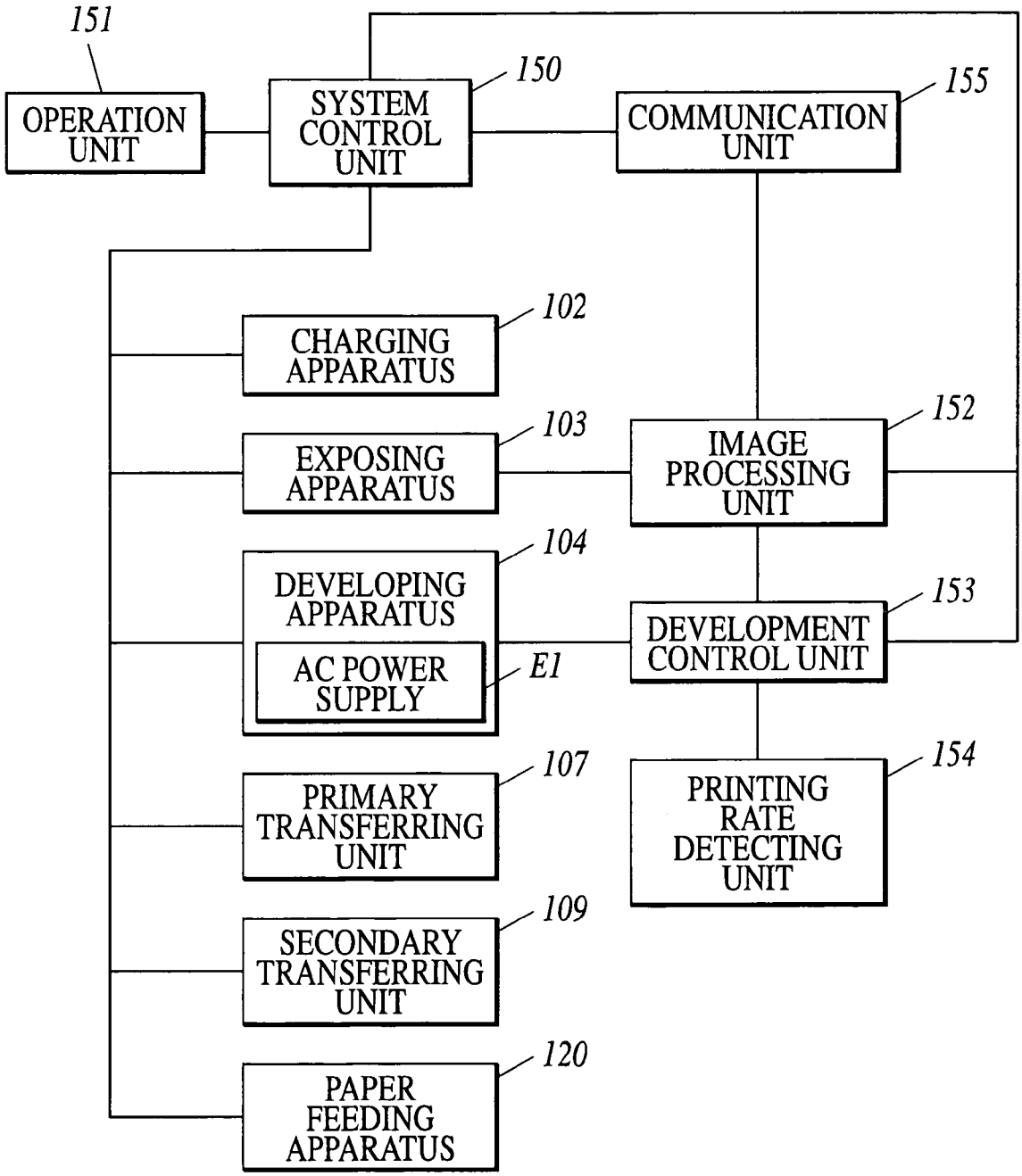
FIG. 10 is a block diagram of an image forming apparatus control system according to the second embodiment of the present invention.

FIG. 10 is the block diagram of an image forming apparatus control system according to the second embodiment.

The image forming apparatus A2 includes a a system control unit 150, an operation unit 151, an image processing unit 152, a development control unit 153, printing rate detecting unit 154, a communication unit 155 and the like.

The system control unit 150 controls the entire image forming apparatus A2. That is, in an image forming step to form an image on the recording paper P., the system control unit 150 starts and/or stops the charging apparatus 102, the exposing apparatus 103, the developing apparatus 104, the primary transfer unit 107, and the secondary transfer unit at predetermined timing to form an image on the recording paper P.

The operation unit 151 sets and inputs image formation data. The image processing unit 152 generates the image data which drives the exposing apparatus 103 based on the image data obtained by reading a manuscript or image data received from an external apparatus.

The development control unit 153 performs the control to change the frequency f of an alternating voltage Vac outputted from the alternating-current power supply E3, which applies the developing bias voltage of the developing apparatus 104, based on a detection result of the printing rate detecting unit 154.

When the printing rate detected by the printing rate detecting unit 154 is lower than a specified value, the development control unit 153 performs the control to lower the frequency f of the alternating voltage Vac outputted form the alternating-current power supply E3.

In the case where the frequency f of an alternating voltage is set low, when the development control unit 153 detects at least one of followings, use of coated paper, developing agent life, or humidity of equipment circumferential environment of the image forming apparatus, the development control unit 153 performs the control to changes $V_0$-Vdc into a high value, based on the detected value. Here, the reference mark $V_0$ denotes the charged voltage of the photosensitive drum 101, and the reference mark Vdc denotes the direct-current voltage of the direct-current power supply E4.

The printing rate detecting unit 154 calculates a printing rate based on an image area and image data. Additionally, the printing rate detecting unit 154 calculates a printing rate based on the operation time of the developing apparatus 104 and image data.

In the image quality control step in a copied image forming step, in order to control the alternating-current power supply E3 based on a printing rate and control the alternating voltage Vac, the development control unit 153 calculates the entire image area based on the size information and the sheet number information which have been set by an operator from the operation unit 151. The development control unit 153 also inputs image data from the image processing unit 152, and calculates an image data quantity. When the image is a binary format image, the image data quantity is the integrated value of the dot number of black pixels. When the image is a multilevel image, the image data quantity is an integrated quantity of pixels.

The development control unit 153 calculates the percentage of the image data quantity to the entire image area, $\int Gd/\int Gs \times 100$ for every image formation of a predetermined number of sheets. The development control unit 153 controls the alternating-current power supply E3 based on the calculation result, and thus controls the alternating voltage Vac.

Here, in the calculation of the printing rate, the printing rate can be also calculated by an approximate calculation such as the calculations based on the supposition that the widths of images are constant independent of sizes and the value obtained by integrating the lengths of the images (the length of the recording material P in the conveying direction in FIG. 7) is taken as the entire image area $\int Gs$.

Moreover, regarding that the deviation of the particle size distribution of a toner due to selective development occurs when a toner consumption rate is low, the printing rate can be obtained by performing an approximation calculation which takes the toner consumption, the percentage of the image data quantity to the rotation quantity of the developing agent carrying body 141A in FIG. 8, as the printing rate. Incidentally, the rotation quantity of the developing agent carrying body 141A corresponds to the operation time of the developing apparatus 104.

In the print image forming step to perform image formation based on the image data received externally, the development control unit 153 calculates the entire image area based on the size information and the sheet number information of the recording image, obtained from the communication unit 155, and calculates the image data quantity based on the image data included in one job. Further more, the development control unit 153 calculates the printing rate from these calculation results.

The development control unit 153 controls the alternating-current power supply E3 based on the calculated printing rate to control the alternating voltage Vac variably.

Control of the alternating voltage Vac is the control that makes a frequency of the alternating voltage Vac low when the printing rate is low. As an aspect of the control of the frequency of the alternating voltage Vac, the frequency of the alternating voltage Vac may be continuously changed according to the printing rate, or the frequency of the alternating voltage Vac may be related to the printing rate stepwise. As a typical aspect of the control, there is a way that sets a threshold value of the printing rate. Then, when the printing rate is equal to or more than the threshold value, the standard frequency of the alternating voltage Vac is applied. When the printing rate is below the threshold value, the frequency of the alternating voltage Vac lower than the threshold value is applied.

By such frequency control of an alternating bias voltage, selection development is suppressed, and high image quality can be always maintained.

When the frequency f of the alternating voltage Vac of the developing bias voltage is set low constantly, there are cases when a measure to prevent fogging is needed. When the measure to prevent fogging is taken by increasing constant fogging margin, adhesion of carrier increases, and leads to decrease in developing agent amount.

Figure 11:
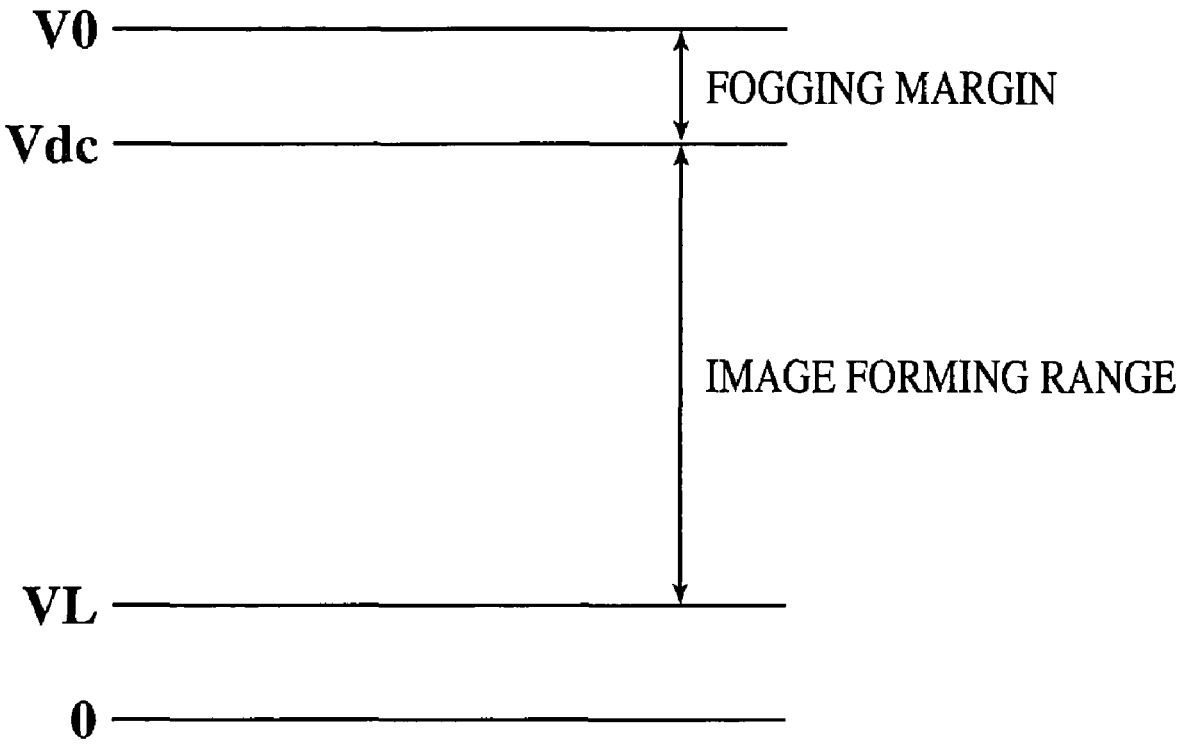
FIG. 11 is a view illustrating a fogging margin.

The "fogging margin" is described using FIG. 11.

FIG. 11 shows the surface potential of the photosensitive body 101. In FIG. 11, the reference mark $V_0$ denotes the charged potential of the photosensitive body 101, namely the surface potential of the un-exposed photosensitive body 101 charged by the charging apparatus 102. The reference mark Vdc denotes the potential of a direct-current component of developing bias. The reference mark VL denotes the maximum exposing unit potential, namely the surface potential of the photosensitive body 101 that was charged by the charging apparatus 102 and exposed with the maximum strength by the exposing apparatus 103.

In development, a toner adheres to the potential unit of an image forming range of Vdc-VL, and forms an image. The $V_0$-Vdc is a potential range in which the toner does not adhere, and is called as the fogging margin.

Theoretically, toner does not adhere to the potential portion of range of the fogging margin, but toner adheres to the portion of the photosensitive body 101 within the potential in range of the fogging margin, when force other than electrostatic force or reversely charged toner exists, and the fogging is generated.

When the fogging margin $V_0$-Vdc is narrowed, the fogging becomes easy to generate. When the fogging margin $V_0$-Vdc is widened, the fogging becomes difficult to generate.

Moreover, when the frequency f of the alternating voltage Vac of the developing bias voltage is low, image unevenness is generated in a solid image of a photography image or the like.

According to the aforementioned second embodiment, the changes of the particle size distribution of the toner in developing unit when selective development is performed for images with different printing rate, resulting deterioration of image quality such as development fogging, half-tone roughening, and the scattering of toner can be prevented, thus an image forming apparatus which stably forms an image having high image quality can be realized.

Although the particle size distribution of the toner in the developing unit shifts to a small particle diameter side due to the selective development and it becomes easy to generate the deterioration of image quality and the scattering of the toner, these undesirable phenomena are fully prevented, and the image forming apparatus which stably forms an image having high image quality is realized by the second embodiment.

The undesirable phenomena that are produced by selective development are prevented substantially by the second embodiment.

A printing rate can be detected without adding any special equipment for detecting the printing rate by the second embodiment.

EXAMPLES

Hereinafter, specific examples for the first embodiment is given in examples 1-3 and specific examples for the second embodiment is given in examples 4 and 5.

Example 1 direct-current voltage Vdc: −500V alternating voltage Vac:

1.0 kV(pp) when printing rate equal to or more than 2%

1.5 kV(pp) when printing rate less than 2% alternating current frequency: 5 kHz (pp) development interval Ds: 0.3 mm (shortest distance between image carrying body and developing agent carrying body)

speed ratio Vs/Vp: 2

(ratio of line speed ratio Vs of developing agent carrying body and linear speed Vp of image carrying body; image carrying body and developing agent carrying body move in same direction)

developing agent conveying quantity M: 200-240 g/m$^2$

In comparison example 1, the image was formed under the same conditions as those of Example 1 except that the alternating voltage Vac(pp) was set to be constant at 1.0 kV, independent of the printing rate.

The results of the image quality evaluation at the stage at which 5000 images with the printing rate of 1% have been formed, are as shown in Table 2. Because the threshold value of the printing rate was set to 2%, the alternating voltage Vac=1.5 kV was applied in Example 1, and the alternating voltage Vac=1.0 kV was applied in Comparison Example.

TABLE 2

| | Vac (pp) | Half-Tone Roughening | Fogging | Toner Scattering |
|---|---|---|---|---|
| Example 1 | 1.5 kV | ○ | ○ | ○ |
| Comparison Example 1 | 1.0 kV | Δ | Δ | X |

In Table 2, each mark indicates the following states.

○: there are almost no deterioration in image quality, and the image quality is sufficiently good;

Δ: deterioration of image quality has occurred;

X: remarkable deterioration of image quality has occurred.

Examples 2 and 3

The conditions shown in Table 3 were set, and the image quality was evaluated at the stage at which 10000 images with the printing rate of 1% were formed.

TABLE 3

| | | Vs/Vp | Vac (pp) |
|---|---|---|---|
| Example 2 | H | 1.8 | 1.0 |
| | L | 1.5 | 1.5 |
| Example 3 | H | 1.8 | 1.0 |
| | L | 1.8 | 1.5 |
| Comparison Example 2 | H | 1.8 | 1.0 |
| | L | 1.8 | 1.0 |
| Comparison Example 3 | H | 1.8 | 1.0 |
| | L | 1.5 | 1.5 |

The evaluation results of the image quality are shown in Table 4. In Table 3, a letter H indicates the case where the printing rate is 2% or more, and a letter L indicates the case where the printing rate is less than 2%.

TABLE 4

| | Example 2 | Example 3 | Comparison Example 2 | Comparison Example 3 |
|---|---|---|---|---|
| Half-Tone Roughening | ○ | □ | X | — |
| Fogging | ○ | □ | X | — |
| Toner Scattering | ○ | ○ | X | — |

In Table 4, each mark indicates the following states.

○: there are almost no deterioration in image quality, and the image quality is sufficiently good;

□: some deterioration of image quality has occurred, but the deterioration is within an allowable range;

X: remarkable deterioration of image quality has occurred.

Here, the mark - indicates that, because the deterioration of the density was remarkable and there is no worth in evaluating the other items, no evaluation was performed.

Example 4

In the present embodiment, the decrease of the carrier quantity due to the carrier adhesion is prevented by setting the frequency f low only at the time of low coverage (low printing rate). That is, at the time of the low coverage, the unevenness is difficult to be noticeable. Moreover, it is characters that are mainly printed at the time of the low coverage, and, in the case of a character, unevenness does not pose a problem.

TABLE 5

| Coverage | f (kHs) |
|---|---|
| ≧2% | 5 |
| <2% | 3 |

Table 5 shows the frequency control of the alternating voltage at the time of the low coverage.

In the case where the printing rate is 2% or more, the frequency f is set to 5 kHz. In the case of the low coverage where the printing rate is below 2%, the switching control of the frequency f to 3 kHz is performed.

Figure 12:
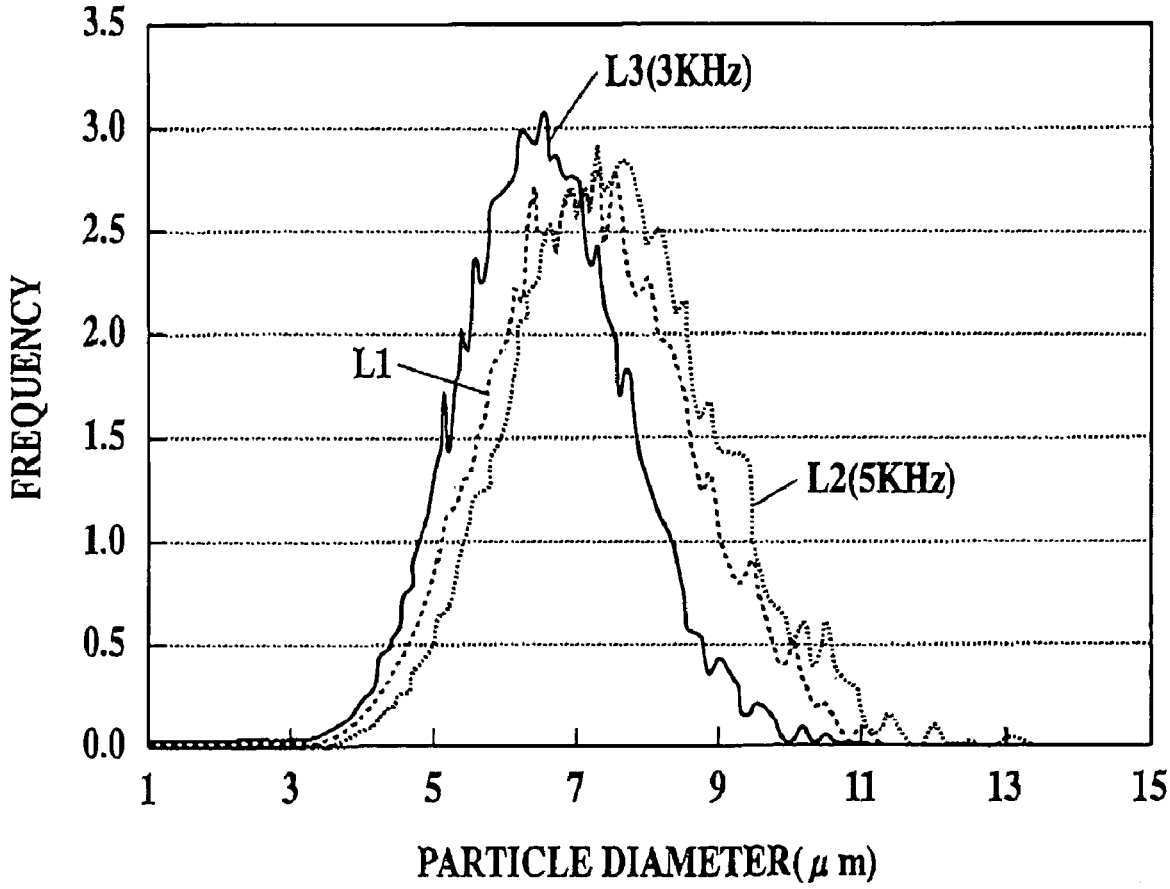
FIG. 12 is a characteristic diagram showing changes in particle size diameter distribution.

FIG. 12 is a characteristic diagram showing the changes of the particle diameter distribution.

A reference mark L1 denotes the particle size distribution curve of the toner in the developing apparatus at the time of a start, i.e. before the toner has been consumed by development. Reference marks L2 and L3 denote the particle size distribution curves of the toner which forms a toner image on the photosensitive drum 101 when development is performed by applying the alternating bias voltages shown in Table 5. The reference mark L2 denotes the particle size distribution curve of the toner in the developing apparatus in the case frequency f is 5 kHz. The reference mark L3 denotes the particle size distribution curve of the toner in the developing apparatus in the case frequency f is 3 kHz.

FIG. 12 shows the results in the case where development is performed under the following conditions.

direct-current voltage Vdc: −500 V alternating voltage Vac: 1.0 kVp-p frequency f of alternating voltage: 5 kHz, 3 kHz interval of development region (shortest distance between photosensitive drum 101 and developing agent carrying body 141A) Ds: 0.3 mm line speed ratio of developing agent carrying body 141A to photosensitive drum 101 Vs/Vp: 2 (line speed of photosensitive drum 101=Vp, line speed of developing agent carrying body 141A=Vs)

developing agent conveying quantity M by developing agent carrying body 141A: 200-240 g/m$^2$ As apparent from FIG. 12, as the frequency f of the alternating voltage Vac is higher (5 kHz), the toner having larger particle diameters is preferentially consumed. As the frequency f of the alternating voltage Vac is lower (3 kHz), the toner having smaller particle diameters is preferentially consumed.

As apparent from the fact that the particle size distribution of a new toner and the particle size distributions of the toner used in the development are shifted from each other, the particle size distribution of the toner in the developing apparatus changes as the development advances in the development performed under the alternating electric field. That is, when developing is performed under a development bias having a high frequency value, the toner having larger particle diameters is preferentially consumed. As a result, the ratio of the toner having smaller particle diameters in the toner in the developing apparatus 104 becomes higher. When the development is performed under a development bias of a lower frequency value, the toner having the smaller particle diameters is preferentially consumed. As a result, the ratio of the toner having the larger particle diameters in the toner in the developing apparatus 104 becomes higher.

In the case where the frequenct value of the alternating voltage is set so that the particle size distribution of the toner consumed in development may agree with the particle size distribution of a new toner, the particle size distribution of the toner in the developing apparatus 104 does not change theoretically even if the development is continued. However, such setting is practically very difficult, and the changes of the particle size distribution of the toner in the developing apparatus 104 are inevitable.

TABLE 6

| Low Coverage Control | f (kHz) | Half-Tone Roughening | Development Fogging | Toner Scattering |
|---|---|---|---|---|
| None | 5 | Δ | Δ | X |
| Exist | 3 | ○ | ○ | ○ |

Table 6 shows performance comparison of the frequency control existence of the alternating voltage Vac at the time of the low coverage.

In Table 6, a reference mark ○ indicates the state where there is almost no deterioration of image quality and the image quality is sufficiently good. A reference mark Δ indicates the state where deterioration of image occurred. A reference mark X indicates the state where remarkable deterioration of image quality occurred.

At the time of the low coverage, by performing the frequency control to change the frequency f to 3 kHz, the half-tone roughening and the development fogging are reduced, and especially, the toner scattering is remarkably improved.

Figure 13:
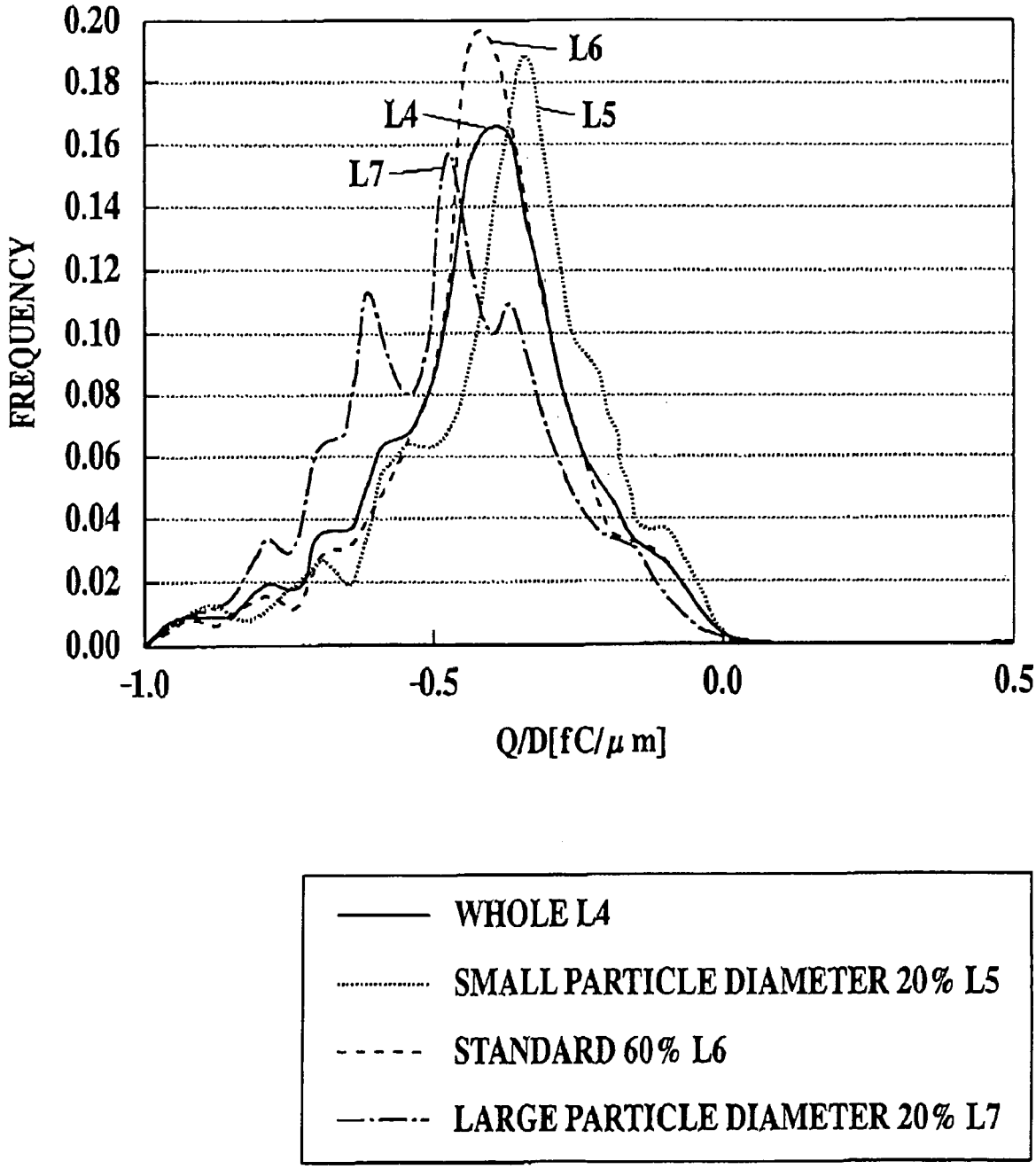
FIG. 13 is a characteristic diagram showing charge quantity distribution of a toner.

FIG. 13 is a characteristic diagram showing the charge quantity distribution of a toner.

In FIG. 13, the charge quantity shows the charge quantity each toner particles has, and is expressed by charge quantity/particle diameter (Q/D). The unit is fC/μm.

L4 indicates the charge quantity distribution of the entire toner. A curve L5 indicates the charge quantity distribution of the particles that compose smallest 20% within particle diameters. A curve L6 indicates the charge quantity distribution of the particles that compose central 60% within particle diameters. A curve L7 indicates the charge quantity distribution of the particles that compose largest 20% within particle diameters.

Figure 14:
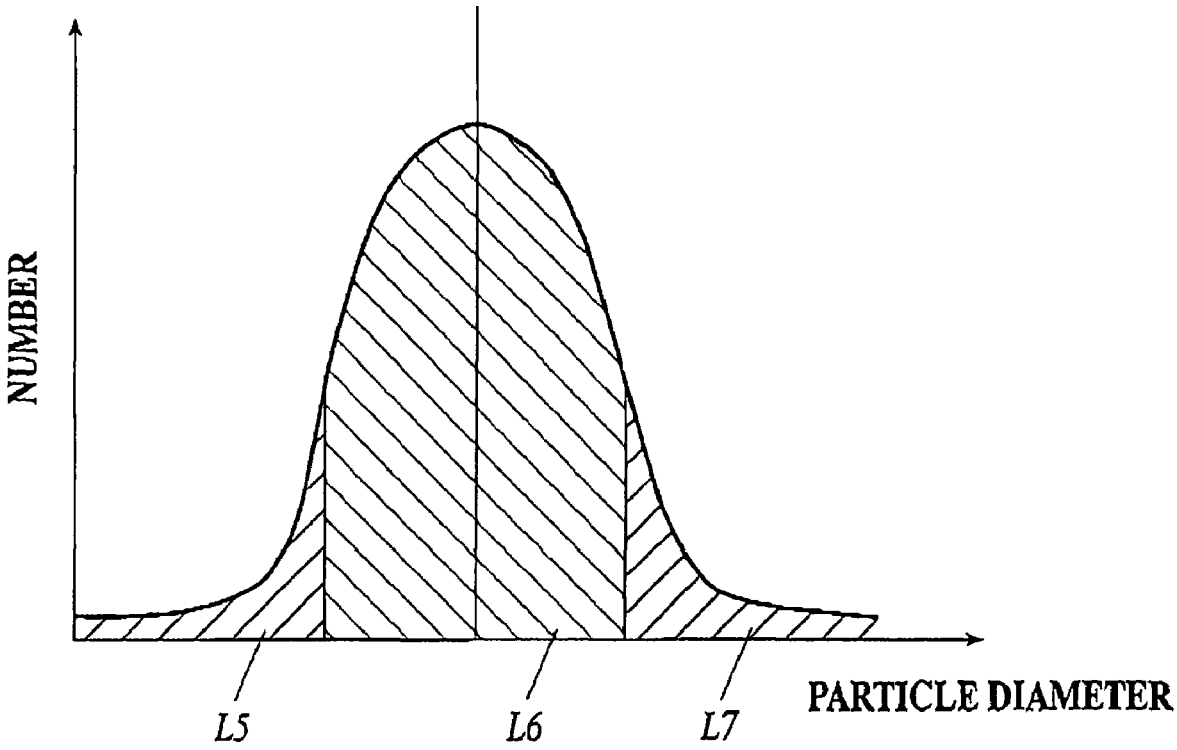
FIG. 14 is a characteristic diagram showing sampling ranges of the toner particles at the time of measuring the charge quantity distribution.

FIG. 14 is a characteristic diagram showing the sampling ranges of toner particles at the time of measuring the charge quantity distribution. Particles in the particle diameter range denoted by reference marks L5, L6 and L7 shown in FIG. 14 have charge quantity distributions shown by charge quantity distribution curves L5, L6 and L7 shown in FIG. 13, respectively.

The charge quantities Q/D of FIG. 13 are the results of the measurement of the charge quantities at the stage at which 5,000 sheets of images have been formed by the execution of development under the following conditions using a negatively charged toner.

direct-current voltage Vdc: −500 V alternating voltage Vas: 1 kV alternating current frequency: 5 kHz development interval Ds: 0.3 mm speed ratio Vs/Vp: 2 developing agent conveying quantity M: 200-240 g/m$^2$ printing rate: 1% (ratio of image area having density exceeding 0 to the entire image area)

As apparent from FIG. 13, the smaller the particle diameter of a toner is, the lower the charge quantity of the toner is. It is well known that a development property changes by the difference of the charge quantity Q/D. When the charge quantity Q/D lowers, the generation of fogging or toner scattering becomes easy to occur, and the roughening of a half-tone image comes to be conspicuous.

From the experiment results described above, it can be known that the particle size distribution of a toner changes as image formation is repeated, and that this change changes the charge quantity of the toner. Furthermore, the change of the charge quantity may influence image quality to cause the deterioration of the image quality.

Such a tendency becomes strong in the case of forming many images of a low printing rate. That is, when the images of low printing rates are formed so much, image formation is continuously performed in the state of small toner supply quantity. As a result, the deviation of the particle size distribution of the toner in the developing apparatus becomes large by selective development at a particle size distribution of the toner in developing apparatus, and the deterioration of the image quality results.

From the knowledge based on such an experiment, in the present embodiment, the printing rate of the image to be formed is detected, and the alternating voltage Vac in a development bias is controlled based on the detection result. Because a particle size distribution of the toner used for development changes according to the changes of the alternating voltage Vac as shown in FIG. 12, it becomes possible to control the particle sized distribution of the toner in the developing apparatus 104 by the control of the alternating voltage Vac, and it also becomes possible to prevent the deviation of the particle size distribution of the toner in the developing apparatus produced by forming the low printing rate images.

That is, the frequency f of the voltage Vac in the development bias is controlled based on the detection result. By the control, the changes of the particle size distribution of the toner in developing apparatus are suppressed, and undesirable phenomena such as fogging, half-tone roughening, toner scattering and the like are sufficiently suppressed.

To put it concretely, when the printing rate is detected, and the printing rate is low, the control of changing the frequency f of the alternating voltage Vac to a lower value is performed.

Hereupon, the printing rate is the ratio $\int Gs/\int Gd \times 100\%$ of the total image area $\int Gs$, a cumulative value of image areas Gs, to the entire image data quantity $\int Gd$, the cumulative value of the image data quantity Gd of the images having densities being not zero, which are formed in the entire image area $\int Gs$. The printing rate is calculated every formation of a predetermined sheets of images.

The predetermined number of sheets is the number of sheets previously determined to be a certain number such as 100 sheets, or the number of sheets formed by one image formation job set with an operation unit or from the outside, and it is also possible to combine the numbers to form the predetermined number.

Example 5

Development conditions are shown below.

printing rate: 1% frequency f of alternating voltage Vac: 3 kHz direct-current voltage Vdc: −500V alternating voltage Vac: 1.0 kVp-p interval of development regions (shortest distance between photosensitive drum 101 and developing agent carrying body 141A) Ds: 0.3 mm line speed ratio of developing agent carrying body 141A to photosensitive drum 101 Vs/Vp: 2 (line speed of photosensitive drum 101=Vp, line speed of developing agent carrying body 141A=Vs)

developing agent conveying quantity M by developing agent carrying body 141A: 200-240 g/m$^2$

TABLE 7

| (1) Kind of Paper: Limited to Plain Paper | | |
|---|---|---|
| Peripheral Humidity | Fogging Margin | Fogging on Plain Paper (Relative Reflection Density) |
| Fogging Margin Control Performed | | |
| RH % ≦ 50 | 150 V | = 0 |
| 50 < RH % ≦ 60 | 200 V | 0.001 |
| 60 < RH % | 250 V | 0.003 |
| Fogging Margin Control not Performed | | |
| RH % ≦ 50 | 150 V | = 0 |
| 50 < RH % ≦ 60 | 150 V | = 0.004 |
| 60 < RH % | 150 V | = 0.006 |
| (2) Circumferential Humidity < 50% | | |
| Kind of Paper | Fogging Margin | Fogging on Plain Paper (Relative Reflection Density) |

TABLE 7-continued

| | | |
|---|---|---|
| Fogging Margin Control Performed | | |
| Plain Paper | 150 V | = 0 |
| Glossy Paper | 250 V | = 0.002 |
| Fogging Margin Control not Performed | | |
| Plain Paper | 150 V | = 0 |
| Glossy Paper | 150 V | = 0.005 |

Table 7 shows performance comparison of the fogging margin control existence at the time of the low coverage. Incidentally, in any example of the tables, the frequency control is performed, and any of the examples are is in the range of the present invention.

Table 7(1) shows the relations between the circumferential environmental humidity and the fogging margin control.

The circumferential environment humidity RH is variably set to three steps of being less than 50%, being within a range of from 50% to 60%, inclusive, and being over 60%. The development fogging on plain paper was measured as relative reflection densities between white ground densities and fogging densities.

In case of performing the fogging margin control, the development fogging on plain paper was within a range of 0 to 0.003 in the circumferential environment humidity RH mentioned above.

In the case of not performing the fogging margin control, the development fogging on plain paper causes no problems in the low humidity of 50 RH % or less, but increases to be within a range of from 0.004 to 0.006 under the environment of the normal humidity within a range of 50% to 60%, inclusive, or a high humidity exceeding 60% in the circumferential environment humidity RH mentioned above.

Table 7(2) shows the relations between two kinds of recording paper, plain paper and glossy paper, as an example of coated paper, and the fogging margin control in the state of fixing the circumferential environment humidity to 50% or less.

In case of performing the fogging margin control, the development fogging on the plain paper was 0, and the development of the glossy paper was within a minute range of 0.002 in the circumferential environment humidity RH mentioned above. In both cases, good results were obtained.

In the case of not performing the fogging margin control, although the development fogging on the plain paper was 0, the development fogging on the glossy paper increased to 0.005 in the circumferential environment humidity RH mentioned above.

In the present example, the fogging is made to be decreased by setting the fogging margin to high at the time of using the coated paper, or when the circumferential humidity is high. As described above, it is preferable to perform the fogging control according to the environment (circumferential humidity and the like) and paper kinds.

As shown in the present example, by performing the fogging margin control in addition to the frequency control, the development fogging is also suppressed, and it becomes possible to improve the image quality further.

Moreover, it is considerable that the charged quantity is reduced and fogging becomes easy to generate according to the developing agent life. The developing agent life corresponds to the time during which a developing agent is used by an image forming apparatus. The time is detected based on the printed copy number after the exchange of a developer or a developing agent (including the initial use case). Alternatively, it is detected based on cumulative values of the running distance of a developing roller or the rotation time thereof after the exchange of a developer or the exchange of a developing agent (including the initial use case).

Consequently, it becomes possible to prevent the fogging furthermore by performing the fogging margin control according to the developing agent life.

The present invention is not limited to the aforementioned embodiments, and therefore various kinds of improvements and/or structure modifications can be made without departing from the scope of the present invention.

What is claimed is:

1. An image forming apparatus, comprising:

an image carrying body;

a latent image forming unit to form an electrostatic latent image on the image carrying body;

a developing unit to form a toner image by developing the electrostatic latent image on the image carrying body, the developing unit including a developing agent carrying body to carry a developing agent in a development region, and a direct-current power supply and an alternating-current power supply which apply a developing bias voltage to the developing agent carrying body, the developing bias voltage being generated by superimposing a direct-current voltage on an alternating voltage;

a printing rate detecting unit to detect a printing rate; and a control unit to control the alternating-current power supply, wherein the control unit performs control to change an output from the alternating current power supply during a development process in an image forming process, based on a detection result of the printing rate detecting unit.

2. The image forming apparatus of claim 1, wherein the control unit performs control to change a value of the alternating voltage based on the detection result of the printing rate detecting unit.

3. The image forming apparatus of claim 2, wherein the control unit performs control to change the alternating voltage to a higher value when the printing rate is low.

4. The image forming apparatus of claim 2, wherein the control unit controls a ratio Vs/Vp of a linear speed Vs of the developing agent carrying body to a linear speed Vp of the image carrying body based on the detection result of the printing rate detecting unit.

5. The image forming apparatus of claim 2, wherein the printing rate detecting unit calculates the printing rate based on image area and image data.

6. The image forming apparatus of claim 2, wherein the printing rate detecting unit calculates the printing rate based on operation time of the developing unit and image data.

7. The image forming apparatus of claim 2, wherein the value of the alternating voltage controlled to change by the control unit is a peak to peak level of the alternating voltage.

8. The image forming apparatus of claim 1, wherein the control unit performs control to change a frequency of the alternating voltage based on the detection result of the printing rate detecting unit.

9. The image forming apparatus of claim 8, wherein, when the printing rate detected by the printing rate detecting unit is lower than a specified value, the control unit performs control to make the frequency of the alternating voltage outputted from the alternating-current power supply to be lower than a frequency of the alternating voltage outputted from the alternating-current power supply when the printing rate detected by the printing rate detecting unit is the specified value or higher.

10. The image forming apparatus of claim 9, wherein, when the frequency of the alternating voltage is set to be lower, the control unit performs control to change a value of the expression $|V_0\text{-Vdc}|$ to a higher value when the control unit detects, based on a detection result, at least one of: use of coated paper, that a developing agent life has exceeded a predetermined value, and that circumferential environment humidity of the image forming apparatus has exceeded a predetermined value, where $V_0$ denotes a charged voltage of the image carrying body, and Vdc denotes the direct-current voltage outputted from the direct-current power supply.

11. The image forming apparatus of claim 10, wherein the printing rate detecting unit calculates the printing rate based on image area and image data.

12. The image forming apparatus of claim 10, wherein the printing rate detecting unit calculates the printing rate based on operation time of the developing unit and image data.

13. The image forming apparatus of claim 8, wherein the printing rate detecting unit calculates the printing rate based on image area and image data.

14. The image forming apparatus of claim 8, wherein the printing rate detecting unit calculates the printing rate based on operation time of the developing unit and image data.

* * * * *